US007220526B2

(12) United States Patent
Oshiba et al.

(10) Patent No.: US 7,220,526 B2
(45) **Date of Patent: *May 22, 2007**

(54) IMAGE FORMING METHOD

(75) Inventors: Takeo Oshiba, Hachioji (JP); Masao Asano, Hachioji (JP); Hiroshi Yamazaki, Hachioji (JP)

(73) Assignee: Konica Minolta Holdings, Inc. (JP)

( * ) Notice: Subject to any disclaimer, the term of this patent is extended or adjusted under 35 U.S.C. 154(b) by 227 days.

This patent is subject to a terminal disclaimer.

(21) Appl. No.: 10/802,096

(22) Filed: Mar. 15, 2004

(65) Prior Publication Data

US 2005/0202334 A1 Sep. 15, 2005

(51) Int. Cl.
*G03G 15/08* (2006.01)

(52) U.S. Cl. ..... 430/120; 430/56; 430/97

(58) Field of Classification Search ..... 430/120, 430/56, 97

See application file for complete search history.

(56) References Cited

U.S. PATENT DOCUMENTS

| | | | | |
|---|---|---|---|---|
| 6,208,821 | B1 * | 3/2001 | Grune et al. | 399/159 |
| 6,366,750 | B1 * | 4/2002 | Swain | 399/116 |
| 6,689,522 | B2 * | 2/2004 | Yamazaki et al. | 430/45 |
| 6,889,020 | B2 * | 5/2005 | Toriyama et al. | 399/159 |
| 6,902,856 | B2 * | 6/2005 | Matsushima et al. | 430/45 |

FOREIGN PATENT DOCUMENTS

| | | |
|---|---|---|
| JP | 02-118684 | 5/1990 |
| JP | 04-338974 | 11/1992 |
| JP | 05-333615 | 12/1993 |
| JP | 06-019377 | 1/1994 |
| JP | 08-202204 | 8/1996 |
| JP | 10-232509 | 9/1998 |
| JP | 11-125931 | 5/1999 |
| JP | 2000-075536 | 3/2000 |
| JP | 2001-154407 | 6/2001 |
| JP | 2001-228647 | 8/2001 |
| WO | WO 00/49466 | 8/2000 |

OTHER PUBLICATIONS

Notification of Reaseons for Refusal from JP Patent Office in connection with JP2001-279515, mailed Feb. 20, 2007, 4 pages.

* cited by examiner

*Primary Examiner*—John L Goodrow
(74) *Attorney, Agent, or Firm*—Squire, Sanders & Dempsey L.L.P.

(57) ABSTRACT

An image forming method which can provides excellent cleaning property, no occurrence of unusual noise or curling of a blade, and a high quality image. The method includes forming a latent image on a cylindrical electrophotographic photoconductor including a mass additive therein; and developing the latent image with a developer comprising a toner, wherein the toner comprises a ratio (Dv50/Dp50) of a 50% volume particle size (Dv50) to a 50% number particle size (Dp50) of 1.0 to 1.15, a ratio (Dv75/Dp75) of a cumulative 75% volume particle size (Dv75) from a larger volume particle size to a cumulative 75% number particle size (Dp75) from a larger number particle size of 1.0 to 1.20, and the number of toner particles having a particle size of 0.7×(Dp50) or less in an amount of not greater than 10 number %.

19 Claims, 6 Drawing Sheets

IMAGE FORMING METHOD

BACKGROUND

1. Field of the Art

This invention relates to an image forming method of an electrophotographic type for use in a copying machine or a printer.

2. Description of Related Art

With the recent development of digital technologies, image formation based on the degital method has become dominant in the electrophotographic image forming method. The method of forming a digital image is based on the formation of a positive image from a dot image of e.g. of 400 dpi (number of dots per 2.54 cm) defined by small pixels. There is a demand for image quality enhancing techiques for faithfully reproducing such a dot image formed of small dots.

As one of the image quality enhancing techniques, there have been proposed an electrophotographic developer or an image forming method, in which the particle size distribution of a small particle-sized toner or a toner particle and the shapes of particles thereof are made uniform, using a polymerization toner. The polymerization toner is manufactured by uniformly dispersing a raw material monomer in an aqueous medium and then causing polymerization thereof. Therefore, it is possible to obtain toner which is uniform in particle size distribution, and shapes. However, toner particles of such a small particle-sized toner are mutually chohesive and strongly adhere to the photoconductor, which tends to degrade cleaning property, and cause defective cleaning, such as uneveness of halftone, toner filming, and curling of a cleaning blade. These problems make it difficult to put the technique into practice.

Further, when the toner reduced in particle size is used, there is a problem that the color difference between an image formed at an early stage of deveopment and an image formed after runnings tends to become large.

On the other hand, when a drum-shaped (cylindrical) eletrophotographic photoconductor is employed, the clearning blade more often than not jumps on the surface of the photoconductor drum the without smoothly sliding thereon, to cause chattering, and the chattering can cause resonance of the photoconductor drum to produce offensive noise. Particularly, when the small paritcle-sized toner is used and the cylindrical organic photoconductor is employed, the adhesion of the toner to the photoconductor increases, and the above-mentioned problems in cleaning are liable to occur. To overcome these problems, there has been proposed a method of insertig a filler, a vibration-restraining material, a noise-abosribing material, or the like, within the photroceptor drum, as in Jp-Jitsukaisho-62-127567A, Jp-Tokukaisho-63-271388A, Jp-Tokukaihei-02-118684A, Jp-Tokukaihei-03-44689A, Jp-Tokukaihei-03-45981A, Jp-Tokukaihei-05-188671A, Jp-Tokukaihei-08-146686A, and WO-00/49466. However, for the use of the small paricle-sized toner, no sufficient soultion to the above problems have been provided.

Further, when a contact-type charging device is empolyed which is reduced in the amount of generation of ozone and operates to charge the photorecetpor by bringing a roller type or blade-type member thereof into contact with the photoconductor, due to the additional load of the contact-type charging device, the above-mentioned problem of cleaning, such as the phenomenon of chattering, beocmes laible to occur. More specifically, due to resonance with the chattering phenomenon caused during cleaning, the photoconductor drum and the charging roller are vibrated to produe unsual noise. To overcome this problem, it has been proposed to put various kinds of inserts within the photoconductor drum, as proposed in Jp-Tokukaihei-05-35048A, Jp-Tokukaihei-06-19377A, and Jp-Tokukaihei-05-333615A. However, the chattering phonomenon which is liable to occur during cleaning or due to contact charging when a small paticle-sized toner is employed is not fully investated.

SUMMARY

A first aspect of the present invention is an image forming method comprising:

forming a latent image on a cylindrical electrophotographic photoconductor including a mass additive therein; and developing the latent image with a developer comprising a toner, wherein the toner comprises, a ratio (Dv50/Dp50) of a 50% volume particle size (Dv50) to a 50% number particle size (Dp50) of 1.0 to 1.15, a ratio (Dv75/Dp75) of a cumulative 75% volume particle size (Dv75) from a larger volume particle size to a cumulative 75% number particle size (Dp75) from a larger number particle size of 1.0 to 1.20, and toner particles having a particle size of 0.7×(Dp50) or less in an amount of not greater than 10 number %.

According to the fist aspect of the present invention, cleaning property is excellent, no unusual noise or curling of a blade occur, and accordingly a high quality image can be obtained.

BRIEF DESCRIPTION OF THE DRAWINGS

The present invention will become more fully understood from the detailed description given hereinafter and the accompanying drawing given by way of illustration only. However thus are not intended as a definition of the limits of the present invention. Wherein:

FIGS. 8A to 8F are sectional views showing mass additives 1 to 6 used in embodiments, in which FIGS. 8A to 8F show a mass additive 1 to 6, respectively.

DESCRIPTION OF THE EXEMPLARY EMBODIMENTS

Figure 1:
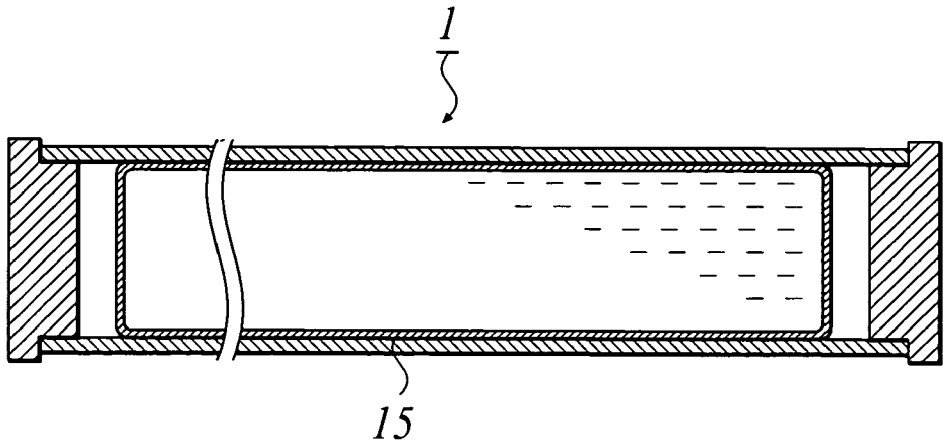
FIG. 1 is a sectional view of an electrophotographic photoconductor drum having a mass additive inserted therein.

Hereinafter, the exemplary embodiments of the image forming method are described.

The image forming method according to the present invention comprises forming a latent image on a cylindrical electrophotographic photoconductor including a mass additive therein; and developing the latent image with a developer comprising a toner.

The image forming method may comprise charging the electrophotographic photoconductor by a contact charging method, before the forming the latent image. Furthermore, the image forming method may comprise cleaning the toner on the electrophotographic photoconductor with a cleaning blade of polyurethane, after the developing the latent image.

(1) The mass additive, (2) the toner, (3) the developer, and (4) the electrophotographic photoconductor, which are used in the above-described image forming method, will be described in first. After that, (5) the image forming method will be described with exemplifications of an image forming apparatus applicable to the embodiments of the image forming method.

(1) Mass Additive

At least part of the mass additive or part of a member enclosing the mass additive can be in contact with an inner surface of the electrophotographic photoconductor. Preferably, the mass additive is a vibration-restraining material or noise-absorbing material.

The vibration-restraining material provided to absorb resonance of the mass additive can have a wide range of elasticity and a mass for displacing a resonance frequency, as conditions for preventing the propagation of vibrations, similarly to a vibration-proof material used in general equipment. Therefore, it is preferable that a vibration-restraining material or a noise-absorbing material disposed inside or on the inner surface of the electrophotographic photoconductor is a heavy material in the form of small pieces or the like, or an elastic material which is brought into pressure contact with an inner surface of the drum via as wide a surface as possible, or filled in the drum.

Further, a method for fixedly mounting the vibration-restraining material on the inner surface of the drum includes a method for affixing the vibration-restraining material by an adhesive, a method for using a pressure contact force of the vibration-restraining material itself, and so forth. Anyway, it is preferable to employ a method which is capable of reliably holding the vibration-restraining material on the inner surface of the drum.

As the mass additive, there may be used vibration-restraining materials, such as metal pieces, wood, resins including polyacetal, polymethyl methacrylate, fluorocarbon resins, silicone, polycarbonate, and polyphenylene sulfide, and heavy materials of metals including SUS and brass.

As the noise-absorbing material, there can be used porous materials, viscoelastic materials, and the like, such as synthetic resins including glass wool, rock wool, polyurethane, polybutadiene rubber, polystyrene, styrene-butadiene rubber, nitrile-butadiene rubber, polyamide-based elastomer, and the like, synthetic rubbers, and natural rubber.

The weight of the mass additive can be not less than 3 g, preferably, not less than 5 g, and not greater than 60 g. The weight of the mass additive can be not less than 3% of the mass of the electrophotographic photoconductor including a flange, preferably, not less than 5%, and not greater than 60%.

To show the form of the above-described mass additive being inserted into the electrophotographic photoconductor drum, for example, FIG. 1 is a sectional view showing an example of the electrophotographic photoconductor drum 1 having the mass additive inserted therein. A polystyrene thin plate 15, which has an outer diameter approximately equal to an inner diameter thereof, and is brought into contact with the inner surface of the electrophotographic photoconductor drum 1 by its own elasticity, is enclosed by the electrophotographic photoconductor drum 1 over the whole region of the effective chargeable width of charging section.

As for the arrangement position for the mass additive inside the electrophotographic photoconductor, the polystyrene thin plate 15 may be disposed at a longitudinal end of the electrophotographic photoconductor drum 1, or at a central portion thereof. Preferably, the polystyrene thin plate 15 is in contact with the inner surface of the electrophotographic photoconductor drum such that the polystyrene thin plate 15 can effectively suppress vibrations to suppress generation of charging noise caused by the vibrations.

(2) Toner

The present inventors have carried out extensive investigation and study on the problem of the conventionally known image forming method using small particle-sized toners (hereinafter, toners having particle sizes of 2 to 10 μm are referred to as "small particle-sized toner"), and found that differences are liable to occur in developing property and cleaning property between particles of the small particle-sized toners, and further the difference in adhesion (adhesive strength) to the electrophotographic photoconductor is liable to be increased between particles of the small particle-sized toners.

Further, the present inventors have found that in the small particle-sized toners, the differences of the developing property and the difference of the amount of adhesion between the toners are increased as the toner particles become small in size. Although a mechanism itself for causing the phenomena is not clear, the present inventors have presumed as follows. That is, in the case of the large particle-sized toners, the difference of the adhesive forces between the toners against the electrophotographic photoconductor is not increased. However, as toner particles are reduced in size, the adhesive forces, which are inherent to the toners, against the electrophotographic photoconductor are increased. Consequently, the above differences between the particles are increased.

As the results of investigation, based on the study of the relationships between a particle size distribution of a small particle-sized toner, abnormal noises generated during cleaning operation, and cleaning property, the toner was configured to have a specific particle size distribution. It was found that by using the toner in combination with the electrophotographic photoconductor including the mass additive, it is possible to improve the problems of abnormal noises generated during cleaning operation and the cleaning property, described above.

More specifically, without reducing the amount of small particle-sized components existing in the toner, the present inventors paid attention to 50% particle size, which is the median of particle sizes of the whole toner. When analyzing the small particle-sized components which deviate in particle size from the 50% particle size, the present inventors paid attention to cumulative 75% frequency particle sizes, which are respectively accumulated from a larger volume particle size and a larger number particle size.

From the above, the image forming method according to the present invention uses toner in which a ratio (Dv50/Dp50) of a 50% volume particle size (Dv50) to a 50% number particle size (Dp50) (hereinafter this ratio can be referred as Dv50/Dp50) is 1.0 to 1.15, a ratio (Dv75/Dp75) of a cumulative 75% volume particle size (Dv75) from a larger volume particle size to a cumulative 75% number particle size (Dp75) from a larger number particle size (hereinafter this ratio can be referred as Dv75/Dp75) is 1.0 to 1.20, and toner comprises toner particles having a particle size of 0.7×(Dp50) or less is not greater than 10 number %. Further, the image forming method uses a cylindrical electrophotographic photoconductor including a mass additive therein.

The volume particle size and number particle size of the toner, and the ratio between the volume particle size and the number particle size will be described.

It is preferable that the toner has a monodisperse particle size distribution. It is preferable that the ratio (Dv50/Dp50) is 1.0 to 1.13.

To suppress the ranges of variations in transferability and the developing property, it is preferable that the ratio (Dv75/Dp75) is 1.1 to 1.19. Of the whole toner, it is preferable the number of the toner particles in the toner is 5 to 9 number %.

The 50% volume particle size (Dv50) (hereinafter this can be referred as Dv50) of the toner can be 2 to 8 μm, more narrowly 3 to 7 μm. The 50% number particle size (Dp50) (hereinafter this can be referred as Dp50) of the toner can be 2 to 7.5 μm. More narrowly, Dp50 is 2.5 to 7 μm.

Now, the cumulative 75% volume particle size (Dv75) (hereinafter this can be referred as Dv75) from a larger volume particle size is defined as a volume particle size in the volume particle size distribution where an accumulation of frequencies of volume particle sizes from the larger volume particle size is 75% of the total volume of the toner, and the cumulative 75% number particle size (Dp75) (hereinafter this can be referred as Dp75) from the larger number particle size is defined as a number particle size in the number particle size distribution where an accumulation of frequencies of number particle sizes from the larger particle size is 75% of the total particle number of the toner.

The Dv50, the Dp50, the Dv75, the Dp75, and the like can be measured by using a "Coulter Counter TA-II", or a "Coulter Multisizer" (both of which are available from Coulter Electronics Inc.).

The electrophotographic photoconductor comprises a photosensitive layer formed on a cylindrical electrically conductive support, and can comprise a mass additive inside the support. By combining the toner described above and the electrophotographic photoconductor containing the mass additive, it is possible to markedly improve the problem of abnormal noises and curling of a blade during cleaning.

A description will be given of components of an electrostatic image-developing toner, components of a binder resin, which is one of the components of the toner, and preparation of the toner.

The toner contains at least colorants and a binder resin. The toner may be manufactured by carrying out pulverization and classification steps, or it may be produced by a so-called polymerization method, referred to hereinafter, for producing toner using resin particles obtained by polymerizing a polymerizable monomer. When the toner is produced by using the polymerization method, it is preferable to use a method for obtaining a colored particle by polymerizing a polymerizable monomer within an aqueous medium. And particularly, it is preferable to use a manufacturing method comprising salting-out/fusing resin particles.

As the polymerizable monomer used in the polymerization method, a radical polymerizable monomer is used as a component, and a crosslinking agent may be used. Further, it is preferable that the polymerizable monomer contains at least one kind of radical polymerizable monomer having an acidic group or radical polymerizable monomer having a basic group, enumerated below.

[Radial Polymerizable Monomer]

The components of the radial polymerizable monomer are not particularly limited, but conventionally known radical polymerizable monomers can be used. Further, it is possible to use one kind of monomer or a combination of two or more kinds of monomers so as to satisfy the requirement of characteristics.

Examples of the components of the radial polymerizable monomer include aromatic vinyl monomers, (meta)acrylate monomers, vinyl ester monomers, vinyl ether monomers, monoolefin monomers, diolefin monomers, and halogenated olefin monomers.

Examples of the aromatic vinyl monomers include styrene monomers and derivatives thereof, such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene.

Examples of the (meta)acrylate monomers include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate, and diethylaminoethyl methacrylate.

Examples of the vinyl ester monomers include vinyl acetate, vinyl propionate, and vinyl benzoate.

Examples of the vinyl ether monomers include vinylmethylether, vinylethylether, vinylisobutylether, and vinylphenylether.

Examples of the monoolefin monomers include ethylene, propylene, isobutylene, 1-butene, 1-pentene, and 4-methyl-1-pentene.

Examples of the diolefin monomers include butadiene, isoprene, and chloroprene.

Examples of the halogenated olefin monomers include vinyl chloride, vinylidene chloride, and vinyl bromide.

[Crosslinking Agent]

As a crosslinking agent, a radical polymerizable crosslinking agent may be added in order to improve characteristics of the toner. Examples of the radical polymerizable crosslinking agent include crosslinking agents having two or more unsaturated bonds, such as divinyl benzene, divinyl naphthalene, divinyl ether, diethyleneglycol methacrylate, ethyleneglycol dimethacrylate, polyethyleneglycol dimethacrylate, and diallyl phthalate.

[Radical Polymerizable Monomer Having Acidic Group or Basic Group]

Examples of the radical polymerizable monomer having an acidic group or the radical polymerizable monomer having a basic group include polymerizable monomers containing a carboxyl group, polymerizable monomers containing a sulfonic group, and amine polymerizable monomers, such as primary amine, secondary amine, tertiary amine, and a quaternary ammonium salt.

Examples of the polymerizable monomers containing a carboxyl group include acrylic acid, methacrylic acid, fumaric acid, maleic acid, itaconic acid, cinnamic acid, monobutyl maleate, and monooctyl maleate.

Examples of the polymerizable monomers containing a sulfonic group include sulfonated styrene, allyl sulfosuccinate, and octyl allylsulfosuccinate.

These may have a structure of a metal salt formed from an alkali metal, such as sodium or potassium, or a structure of a metal salt formed from an alkaline earth metal, such as calcium.

Examples of the radical polymerizable monomer having a basic group include amine compounds, such as dimethylaminoethyl acrylate, dimethylaminoethyl methacrylate, diethylaminoethyl acrylate, diethylaminoethyl methacrylate, quaternary ammonium salts of the above four compounds, 3-dimethylaminophenyl acrylate, 2-hydroxy-3-methacryloxypropyltrimethyl ammonium salt, acryl amide, N-butylacryl amide, N,N-dibutylacryl amide, piperidylacryl amide, methacryl amide, N-butylmethacryl amide, N-octadecylacryl amide, vinyl pyridine, vinyl pyrrolidone, vinyl N-methylpyridinium chloride, vinyl N-ethylpyridinium chloride, N,N-diarylmethyl ammonium chloride, and N,N-diarylethyl ammonium chloride.

It is preferable that as the radical polymerizable monomer, the radical polymerizable monomer having an acidic group or the radical polymerizable monomer having a basic group is used within a range of 0.1 to 15 mass % of the total of monomers. Further, preferably, the radical polymerizable crosslinking agent is used within a range of 0.1 to 10 mass % with respect to the total of radical polymerizable monomers, though depending on the characteristics thereof.

[Chain Transfer Agent]

In order to adjust a molecular weight, it is possible to use a chain transfer agent which is generally used. The chain transfer agent is not particularly limited, but octyl mercaptan, dodecyl mercaptan, tert-dodecyl mercaptan, n-octyl-3-ester mercaptopropionate, carbon tetrabromide, and styrene dimer are used.

[Polymerization Initiator]

Any suitable radical polymerization initiators can be used as so long as they are water-soluble. For example, persulfates (potassium persulfate, ammonium persulfate, etc.), azo compounds (4,4'-azobis4-cyanovaleric acid and salts thereof, 2,2'-azobis(2-amidinopropane) salt, etc.), and peroxide compounds can be used as the radical polymerization initiators.

Further, the radical polymerization initiators can be used as Redox initiators by using them in combination with reducing agents as required. By using the Redox initiators, polymerization activity is increased, whereby it is possible to lower a polymerization temperature, and hence shortening of a polymerization time period can be expected.

Although any temperature may be selected as the polymerization temperature so long as it is equal to or higher than a lowest radical forming temperature, a temperature within a range of 50° C. to 90° C. is used. However, when a polymerization initiator for starting polymerization at ordinary temperature, e.g. a combination of hydrogen peroxide and a reducing agent (e.g. ascorbic acid) are used, it is also possible to carry out polymerization at room temperature or a temperature higher than the room temperature.

[Surfactant]

To perform polymerization using the radical polymerizable monomers described above, it is required to disperse oil drops in an aqueous medium using a surfactant. The surfactants usable in this case are not particularly limited, but the following are examples of suitable ionic surfactants.

Examples of the ionic surfactants include sulfonates (sodium dodecylbenzenesulfonate, sodium aryl alkyl polyethersulfonate, sodium 3,3-disulfondiphenylurea-4,4-diazo-bis-amino-8-naphthol-6-sulfonate, ortho-caroxybenzene-azo-dimethylaniline sodium, 2,2,5,5-tetramethyltriphenylmethane-4,4-diazi-bis-β-naphthol-6-sulfonate, and the like), sulfuric acid ester salts (sodium dodecyl sulfate, sodium tetradecyl sulfate, sodium pentadecyl sulfate, sodium octyl sulfate, etc.), fatty acid salts (sodium oleate, sodium laurate, sodium caprate, sodium caprylate, sodium caproate, potassium stearate, calcium oleate, and the like.).

Further, nonionic surfactants as well can be used. Examples of the nonionic surfactants include polyethylene oxide, polypropylene oxide, a combination of polypropylene oxide and polyethylene oxide, esters of polyethylene glycol with higher fatty acids, alkylphenol polyethylene oxide, esters of polypropylene oxide with higher fatty acids, and sorbitan esters.

These are used mainly at the time of emulsion polymerization, but they may be used in some other steps or for other purposes.

[Colorants]

As the colorants, there may be used, for example, inorganic pigments, organic pigments, and dyes.

As the inorganic pigments, there can be used conventionally known pigments. Examples of the inorganic pigments includes the following pigments:

As a black pigment, there can be used carbon black, such as furnace black, channel black, acetylene black, thermal black, and lampblack, and further magnetic powders, such as magnetite and ferrite.

The above organic pigments and dyes can be selectively used singly or in combination of a plurality thereof, as required. Further, the amount of organic pigment added is 2 to 20 mass %, preferably 3 to 15 mass %, with respect to the amount of polymer.

When the toner is used as a magnetic toner, it is possible to add the above-mentioned magnetite. In this case, from the viewpoint of giving predetermined magnetic properties, it is preferable to add an amount of 20 to 60 mass % to the toner.

As the organic pigments and the dyes, there can be used conventionally known pigments and dyes. Examples of the organic pigments and the dyes includes the following colorants:

Examples of the organic pigments for magenta or red include C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222.

Examples of the organic pigments for orange or yellow include C.I. pigment orange 31, C.I. pigment orange 43, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, C.I. pigment yellow 138, C.I. pigment yellow 180, C.I. pigment yellow 185, C.I. pigment yellow 155, and C.I. pigment yellow 156.

Examples of the organic pigments for green or cyan include C.I. pigment blue 15, C.I. pigment blue 15:2, C.I. pigment blue 15:3, C.I. pigment blue 16, C.I. pigment blue 60, and C.I. pigment green 7.

Further, examples of dyes include C.I. solvent red 1, C.I. solvent red 49, C.I. solvent red 52, C.I. solvent red 58, C.I. solvent red 63, C.I. solvent red 111, C.I. solvent red 122, C.I. solvent yellow 19, C.I. solvent yellow 44, C.I. solvent yellow 77, C.I. solvent yellow 79, C.I. solvent yellow 81, C.I. solvent yellow 82, C.I. solvent yellow 93, C.I. solvent yellow 98, C.I. solvent yellow 103, C.I. solvent yellow 104, C.I. solvent yellow 112, C.I. solvent yellow 162, and C.I. solvent blue 25, C.I. solvent blue 36, C.I. solvent blue 60, C.I. solvent blue 70, C.I. solvent blue 93, C.I. solvent blue 95, etc. It is also possible to use mixtures of these.

The above organic pigments and dyes can be selectively used singly or in combination of a plurality thereof, as required. Further, the amount of organic pigment added is 2 to 20 mass %, preferably 3 to 15 mass %, with respect to the amount of polymer.

It is also possible to use a colorant having its surface modified. As a surface modifier, there can be used conventionally known surface modifiers. For example, a silane coupling agent, a titanium coupling agent, an aluminum coupling agent, etc. can be preferably used as the modifiers.

[Release Agent]

The toner may contain a release agent. As the release agent, there can be used low molecular-weight polyolefin wax, such as polypropylene and polyethylene, paraffin wax, Fischer-Trosch wax, ester wax, and the like. Further, ester wax represented by the following general formula (1) can be preferably used.

$$R_1—(OCO—R_2)_n \qquad \text{General Formula (1)}$$

wherein, n designates an integer of 1 to 4, preferably 2 to 4, and more preferably 3 to 4, particularly preferably 4.

$R_1$ and $R_2$ represent hydrocarbon groups which may have substituents, respectively.

$R_1$ has 1 to 40 carbon atoms, preferably 1 to 20 carbon atoms, more preferably 2 to 5 carbon atoms.

$R_2$ has 1 to 40 carbon atoms, preferably 13 to 29 carbon atoms, more preferably 12 to 25 carbon atoms.

Examples of crystalline compounds are shown below. Of course, the crystalline compound is not limited to the examples.

Chemical Formula 1

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6)
$$CH_3—(CH_2)_{20}-COO—(CH_2)_2—\overset{CH_3}{\overset{|}{C}}H—CH_2—O—CO—(CH_2)_{20}-CH_3$$

7)
$$CH_3—(CH_2)_{22}-COO—(CH_2)_2—\overset{CH_3}{\overset{|}{C}}H—CH_2—O—CO—(CH_2)_{22}-CH_3$$

8)
$$CH_3—(CH_2)_{22}-COO—CH_2—\underset{\underset{CH_3}{|}}{\overset{CH_3}{\overset{|}{C}}}—CH_2—O—CO—(CH_2)_{22}-CH_3$$

-continued

9)
$$CH_3—(CH_2)_{26}-COO—CH_2—\underset{\underset{CH_3}{|}}{\overset{CH_3}{\overset{|}{C}}}—CH_2—O—CO—(CH_2)_{26}-CH_3$$

10)
$$\begin{array}{l} CH_2—O—CO—(CH_2)_{26}—CH_3 \\ | \\ CH—O—CO—(CH_2)_{28}—CH_3 \\ | \\ CH_2—O—CO—(CH_2)_{28}—CH_3 \end{array}$$

11)
$$\begin{array}{l} CH_2—O—CO—(CH_2)_{22}—CH_3 \\ | \\ CH—O—CO—(CH_2)_{22}—CH_3 \\ | \\ CH_2—O—CO—(CH_2)_{22}—CH_3 \end{array}$$

12)
$$\begin{array}{l} CH_2—OH \\ | \\ CH—O—CO—(CH_2)_{26}—CH_3 \\ | \\ CH_2—O—CO—(CH_2)_{26}—CH_3 \end{array}$$

13)
$$\begin{array}{l} CH_2—OH \\ | \\ CH—O—CO—(CH_2)_{22}—CH_3 \\ | \\ CH_2—O—CO—(CH_2)_{22}—CH_3 \end{array}$$

14)
$$\begin{array}{l} CH_2—OH \\ | \\ CH—OH \\ | \\ CH_2—O—CO—(CH_2)_{26}—CH_3 \end{array}$$

15)
$$\begin{array}{l} CH_2—OH \\ | \\ CH—OH \\ | \\ CH_2—O—CO—(CH_2)_{22}—CH_3 \end{array}$$

Chemical Formula 2

16)
$$CH_3—(CH_2)_{26}—COO—CH_2—\underset{\underset{CH_2—O—CO—(CH_2)_{26}—CH_3}{|}}{\overset{CH_3}{\overset{|}{C}}}—CH_2—O—CO—(CH_2)_{26}—CH_3$$

17)
$$CH_3—(CH_2)_{20}—COO—CH_2—\underset{\underset{CH_2—O—CO—(CH_2)_{20}—CH_3}{|}}{\overset{CH_2CH_3}{\overset{|}{C}}}—CH_2—O—CO—(CH_2)_{20}—CH_3$$

18)
$$CH_3—(CH_2)_{26}—COO—CH_2—\underset{\underset{CH_2—O—CO—(CH_2)_{26}—CH_3}{|}}{\overset{CH_2—O—CO—(CH_2)_{26}—CH_3}{\overset{|}{C}}}—CH_2—O—CO—(CH_2)_{26}—CH_3$$

19)
$$CH_3—(CH_2)_{20}—COO—CH_2—\underset{\underset{CH_2—O—CO—(CH_2)_{20}—CH_3}{|}}{\overset{CH_2—O—CO—(CH_2)_{20}—CH_3}{\overset{|}{C}}}—CH_2—O—CO—(CH_2)_{20}—CH_3$$

-continued

20)

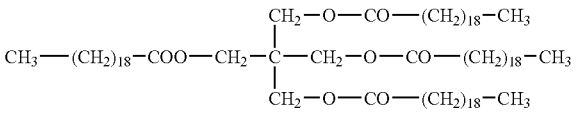

21)

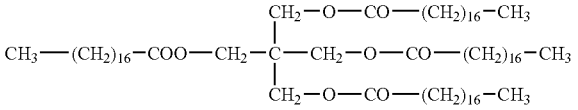

22)

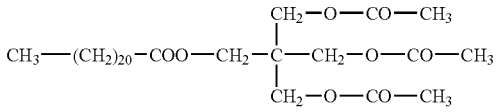

The above ester waxes are contained in resin particles, and has a function of adding an excellent fixing property (adhesiveness to an image support) to the toner obtained by fusing the resin particles.

The amount of the release agent added to the toner is preferably 1 to 30 mass %, more preferably 2 to 20 mass %, and further preferably 3 to 15 mass %, with respect to the whole amount of the toner. Further, it is preferable that the toner is produced by carrying out steps of dispersing a monomer solution formed by dissolving the release agent in the above polymerizable monomer, in water, polymerizing the polymerizable monomer, forming particles having the above-mentioned ester compounds contained in resin particles thereof as release agent, and salting out and fusing the resin particles with colorant particles.

[Charge Control Agent]

The toner may further contain materials capable of adding various functions to the toner, in addition to colorants and the release agent. Concretely, a charge control agent or the like can be cited. The additional component can be added by various methods including a method of adding the component together with the resin particles and the colorant particles in the salting-out/fusing stage, thereby incorporating the component in the toner, and a method of adding the component to the resin particles themselves.

Similarly, as the charge control agent, it is possible to use various types of known charge control agents which can be dispersed in water. Examples of the charge control agents include nigrosine dye, metal salts of naphthenic acid or higher fatty acids, alkoxylated amines, quaternary ammonium salt compounds, azo metal complexes, metal salts of salicylic acid and metal complexes thereof.

[External Additive]

It is possible to add so-called external additives to the toner, so as to improve the fluidity and electrostatic property of the toner, and enhance the cleaning property thereof. The external additives are not particularly limited, but as the external additives, there can be used various kinds of inorganic fine particles, organic fine particles, and a smoothing agent.

As the inorganic fine particles, there can be used conventionally known inorganic fine particles. For example, fine particles of silica, titania, aluminum, etc. can be preferably used. Preferably, the inorganic fine particles have hydrophobic property. Examples of the silica fine particles include R-805, R-976, R-974, R-972, R-812, and R-809 available from Nippon Aerosil Co., Ltd., HVK-2150 and H-200 available from Hoechst Company, TS-720, TS-530, TS-610, H-5, and MS-5 available from Cabot Corp.

Examples of the titania fine particles include T-805 and T-604 available from Nippon Aerosil Co., Ltd., MT-100S, MT-100B, MT-500BS, MT-600, MT-600SS, and JA-1 available from TAYCA Corp., TA-300SI, TA-500, TAF-130, TAF-510, and TAF-510T available from Fuji Titanium Industry Corp., IT-S, IT-OA, IT-OB, and IT-OC available from Idemitsu Kosan Co., Ltd.

Examples of the alumina fine particles include RFY-C and C-604 available from Nippon Aerosil Co., Ltd., and TTO-55 available from Ishihara Sangyo Kaisha, Ltd.

As the organic fine particles, there can be used spherical organic fine particles having a number average primary particle size of approximately 10 to 2000 nm. As the organic fine particles, homopolymers, such as styrene, methyl methacrylate, and the like, or a copolymer of them can be used.

Examples of the smoothing agent include metallic salts of higher fatty acids, such as stearic acid salts of metals including zinc, aluminum, copper, magnesium, and calcium, oleic acid salts of metals including zinc, manganese, iron, copper, and magnesium, palmitic acid salts of metals including zinc, copper, magnesium, and calcium, linoleic acid salts of metals including zinc and calcium, and ricinoleic acid salts of metals including zinc and calcium.

Preferably, the amount of the external additives added to the toner is 0.1 to 5 mass %, with respect to the whole amount of the toner. Examples of methods of adding the external additives include methods using various kinds of conventionally known mixing apparatuses, such as a turbula mixer, a Henschel mixer, a Nauta mixer, and a V-type mixing machine.

[Toner Preparing Method]

Preferably, the toner is prepared by a polymerization method including a process for dispersing the above-described polymerizable monomer or polymerizable monomer solution, which has a release agent dissolved therein, in an aqueous medium, and subjecting an aqueous dispersion system of the monomer solution to polymerization to thereby prepare a liquid dispersion of resin particles containing the release agent, a fusing process for causing fusion of the resin particles using the liquid dispersion of resin particles, a filtering/washing process for separating the obtained toner particles from the aqueous medium by filtration, and washing the toner particles to thereby remove a surfactant and the like therefrom, a drying process for drying the washed toner particles, and an external additive-adding process for adding an external additive to the dried toner particles. Now, the above resin particles may be colored particles. Further, uncolored particles can be used as the resin particles. In this case, by adding the liquid dispersion of the colorant particles and so forth to the liquid dispersion of the resin particles, and then causing the fusion in the aqueous medium, it is possible to obtain colored particles.

As the fusing method, it is particularly preferable to perform salting-out/fusing using the resin particles generated by the polymerization process. Further, when uncolored resin particles are used, the resin particles and colorant particles can be salted out and fused in an aqueous medium.

Further, not only the colorant and the release agent but also the charge control agents, which are components of the toner, can be added as particles in this process.

In the above description, the term "aqueous medium" is intended to mean a medium having a water content of 50 mass % or more. The components other than water include water-soluble organic solvents, such as methanol, ethanol, isopropanol, butanol, acetone, methyl ethyl ketone, and tetrahydrofuran. Out of the above organic solvents, alcohol-based organic solvents, such as methanol, ethanol, isopropanol, and butanol, which do not dissolve any resins, are particularly preferable.

A preferable polymerization method includes a method of adding a water-soluble polymerization initiator to a dispersion which is formed by dispersing a monomer solution prepared by dissolving a release agent in a monomer, in an aqueous medium having a surfactant with a concentration equal to or lower than a critical micelle concentration, dissolved therein, in the form of oil droplets by using mechanical energy, thereby causing radical polymerization of the monomer. In this case, an oil-soluble polymerization initiator may be added to the monomer.

A dispersing apparatus for conducting oil droplet dispersion is not particularly limited, but there may be used Clear Mix, an ultrasonic wave dispersing machine, a mechanical homogenizer, Manton Gaulin, or a pressure homogenizer.

The colorant itself may be used after surface modification thereof. The surface modification of the colorant is performed by dispersing the colorant in a medium, adding a modifier to the medium having the colorant dispersed therein, and then raising the temperature of the dispersion, for reaction. After completion of the reaction, the colorant is filtered, subjected to the filtration and washing repeatedly with the same medium, and dried, to thereby obtain pigment treated by the surface modifier.

There is a method for preparing colorant particles by dispersing the colorant in an aqueous medium. Preferably, the colorant-dispersing process is carried out in the water in a state where the concentration of the surfactant has been made equal to or higher than the critical micelle concentration (CMC).

Although the dispersing machine used in the colorant-dispersing process is not particularly limited, it is preferable to employ pressure dispersing machines, such as Clear Mix, the ultrasonic wave dispersing machine, the mechanical homogenizer, Manton Gaulin, and the pressure-type homogenizer, and medium-type dispersing machines, such as a sand grinder, Getzmann Mill, and Diamond Fine Mill.

In the colorant-dispersing process, the aforementioned surfactant can be used. In the process for performing the salting-out/fusing, a salting-out agent comprised of a an alkali metal salt or an alkaline earth metal salt is added to water in which resin particles and colorant particles are present, as a flocculant to a concentration not lower than a critical flocculation concentration, and then the water is heated to a temperature equal to or higher than a glass transition temperature of the resin particles, whereby salting out and fusing of the resin particles and the colorant particles are caused to proceed at the same time.

Examples of the alkali metal forming an alkali metal salt as the salting-out agent include lithium, potassium, sodium, etc., and examples of the alkaline earth metal forming an alkaline earth metal salt as the salting-out agent include magnesium, calcium, strontium, barium, etc. Among them, potassium, sodium, magnesium, calcium, and barium can be preferably used. Further, examples of the constituent substance of the salts include a chloride salt, a bromide salt, an iodide salt, a carbonate salt, a sulfate salt, and the like.

Although the method for attaining the particle size distribution of the toner is not particularly limited, it is possible to employ any of methods of controlling the particle size distribution e.g. by classification, control of a temperature and time during execution of association, and control of a manner of termination of the association.

As a particularly preferable method for attaining the particle size distribution of the toner, there can be used the method of controlling time, temperature, and a stopping speed of association in the water. More specifically, in the case of performing the salting-out/fusing, it is preferable to make as short as possible a time period over which the aqueous medium is left standing after addition of the salting-out agent. Although the reason for this is not clear, the flocculated state of particles is changed depending on a time period over which the aqueous medium is left standing after the salting-out, causing variations in the particle size distribution and the surface property of a fused toner. The temperature at which the salting-out agent is added is not particularly limited.

It is preferable to employ a method of raising the temperature of the liquid dispersion of resin particles as quickly as possible to the temperature equal to or higher than the glass transition temperature of the resin particles. A time period required for raising the temperature of the liquid dispersion up to the target temperature is shorter than thirty minutes, preferably shorter than ten minutes. Further, it is required to quickly raise the temperature of the liquid dispersion of the resin particles, and preferably a temperature-raising rate in this case is 1° C./min. Although the upper limit of the temperature-raising rate is not particularly definite, from the viewpoint of suppressing the generation of coarse big particles due to a rapid progress of the salting-out/fusing, it is preferable that the upper limit is equal to or lower that 15° C./min. As an especially preferable method, there can be used a method of continuing the salting-out/fusing even after the temperature of the liquid dispersion of the resin particles is raised to a temperature equal to or higher than the glass transition temperature of the resin particles. This method makes it possible to cause the fusion to effectively proceed together with the growth of the particles, thereby making it possible to enhance durability of the toner as a final product.

Further, if a divalent metal salt is used for salting-out and fusing the resin particles during execution of the associating process, it becomes possible to control particle sizes of the toner in particular. Although the reason is not clear, it is presumed that the use of the divalent metal salt makes it possible to increase a repulsive force in salting-out the resin particles, which makes it possible to effectively suppress the dispersion power of the surfactant, resulting in control of the particle size distribution.

Further, it is preferable that a monovalent metal salt and water are added for stopping the salting-out/fusing. The addition of the monovalent metal salt and water makes it possible to stop the salting-out, thereby making it possible to control of the presence of large particle-sized components and small particle-sized components.

In the case of a polymerization toner which is formed by associating or fusing resin particles with each other in an aqueous medium, by controlling the flow of the aqueous medium in a reaction vessel and temperature distribution in a fusing stage, further by controlling a heating temperature, stirring rotation rate and time in a shape-controlling process performed after the fusing process, it is possible to change the shape distribution and shapes of the whole of the toner as desired.

More specifically, In the case of the polymerization toner which is formed by associating or fusing resin particles with each other, a stirring blade and a stirring bath, which are capable of forming a laminar flow of an aqueous medium in a reactor, and making uniform the temperature distribution within the reactor, are used to control temperatures, stirring rotation rates and time in the fusing process and the shape-controlling process, whereby it is possible to form toner having a shape coefficient and a uniform shape distribution. The reason for this is presumed as follows: When fusion is carried out in a field having the laminar flow formed therein, no strong stress is applied to particles (associated or flocculated particles) being subjected to flocculation and fusion, and at the same time the temperature distribution in the stirring bath is made uniform when the accelerated laminar flow exists therein, so that the shape distribution of fused particles is made uniform. Further, the fused particles are progressively made spherical by being heated and stirred in the shape-controlling process after the fusing process, and hence the shape of toner particles can be controlled as desired.

To control the toner for being a predetermined shape, it is preferable to cause the salting-out and the fusing to simultaneously proceed. The method of performing heating after formation of flocculated particles is liable to cause variation in the shape of the particles, and further, it is impossible to suppress generation of fine particles. The reason is presumed that since the flocculated particles are heated, while being stirred, in the aqueous medium, resegmentation of the flocculated particles occurs, so that small particle-sized components tend to be generated.

(3) Developing Agent

When the toner is mixed with a carrier so as to use them as a two-component developing agent, it is possible to use conventionally known materials, such as metals including iron, ferrite, and magnetite, and alloys of any of these metals and metals including aluminum and lead, as magnetic particles of the carrier. Particularly, ferrite particles are preferably used. The magnetic particles have volume average particle size of 15 to 100 μm, and preferably 25 to 80 μm.

Typically, the volume average particle size of a carrier can be measured by "HELOS" (available from SYMPATEC Corp.), which is a laser diffraction-type particle size distribution measuring apparatus equipped with a wet-type dispersion machine.

Preferably, the carrier is one having magnetic particles coated with a resin, or a so-called resin dispersion-type carrier having magnetic particles dispersed in a resin. Although the resin for coating the magnetic particles is not particularly limited, as the coating resin, there can be used e.g. olefin resin, styrene resin, styrene-acrylic resin, silicone resin, ester resin, fluorine-containing polymer resin, etc. Further, although the resin for forming the resin dispersion-type carrier is not particularly limited, there can be used known resins, such as styrene-acrylic resin, polyester resin, fluorocarbon resin, and phenol resin.

The electrophotographic photoconductor will be described. A term "organic photoconductor" is intended to mean a photoconductor in which at least one of a charge generating substance and a charge transport substance, as a constituent of the electrophotographic photoconductor, is formed by an organic compound. Hereinafter, a cylindrical organic photoconductor will be described.

[Conductive Substrate (Conductive Support)]

As a conductive support which is used as the photoconductor, a cylindrical conductive support is used. The term "cylindrical conductive support" is used to mean a support having a cylindrical shape that is required to be capable of forming images endlessly as it rotates. Preferably, the cylindrical conductive support has straightness within a range of 0.1 mm or less, and vibration within a range of 0.1 mm or less. If the straightness and vibration of the support exceed the above ranges, it becomes difficult for the support to form an excellent image.

The conductive support may be a metal drum made of aluminum, nickel, or the like, a plastic drum formed by depositing aluminum, tin oxide, indium oxide, or the like thereon by a vapor deposition method, or a paper/plastic drum coated with a conductive substance. Preferably, the conductive support has a specific resistance of $10^3$ Ω·cm or less at ordinary temperature.

[Intermediate Layer]

The intermediate layer (UCL) used for the photoconductor is disposed between the conductive support and the photosensitive layer so as to improve adhesiveness between the conductive support and the photosensitive layer, or prevent injection of electric charge from the support. Examples of materials for the intermediate layer include polyamide resin, vinyl chloride resin, vinyl acetate resin, and copolymer resin containing repeating units of two or more of the above resins. Out of the above resins, the polyamide resin is preferable as a resin capable of suppressing an increase in residual potential due to repeated use thereof. Further, it is preferable that the intermediate layer formed by using the above resins has a film thickness of 0.01 to 0.5 μm.

An example of a most preferably used intermediate layer is an intermediate layer which is formed by using a thermoset metallic resin obtained by thermosetting an organometallic compound, such as a silane coupling agent, and a titanium coupling agent. Preferably, the intermediate layer formed by using a thermoset metallic compound has a film thickness of 0.1 to 2 μm.

Another example of a preferable intermediate layer is an intermediate layer which contains a titanium oxide and a binder resin, and is formed by dispersing the titanium oxide in a binder resin solution, and applying the solution.

Titanium oxides can be used which are different in crystal form, particle size, and surface treatment state. A preferable example of the titanium oxides is a titanium oxide having an anatase-type crystal structure with particle sizes of 0.02 to 0.5 μm, A more preferable example of the titanium oxides is a titanium oxide not having been subjected to any surface treatment, or a titanium oxide whose surface has been treated with organic silane.

As a binder contained in the intermediate layer, a polyamide resin is preferably used which excellently disperses titanium oxide, and is excellent in adhesiveness between the intermediate layer and the support, and between the intermediate layer and a layer formed thereon. Of course, the binder resin is not limited to the polyamide resin.

[Photosensitive Layer]

The photosensitive layer for the organic photoconductor may be of a one-layered structure in which one layer having a charge generating function and a charge transport function is formed on an undercoat layer, such that the one layer. More preferably, however, the photosensitive layer is of a function-separated structure in which the photosensitive layer is divided into a charge generating layer (CGL) and a charge transport layer (CTL) such that the two layers separately have the respective functions of the photosensitive layer. If the photosensitive layer is of the function-separated structure, it is possible to suppress an increase in rest potential due to repeated use, and it is easy to control other electrophotographic characteristics according to the purpose. Preferably, an organic photoconductor for negative charging is configured such that a charge generating layer (CGL) is formed on an undercoat layer, and a charge transport layer (CTL) is disposed on the charge generating layer (CGL). In the case of an organic photoconductor for positive charging, the order of the layers in the layer structure is reverse to that of the organic photoconductor for negative charging. The most preferable construction of the photosensitive layer is the function-separated structure of the organic photoconductor for negative charging.

[Charge Generating Layer]

A description will be given of the structure of the photosensitive layer of the function-separated organic photoconductor for negative charging.

The charge generating layer contains a charge generating substance and a binder resin and is formed by dispersing the charge generating substance in the binder resin solution, and applying the solution.

The charge generating substance is a known phthalocyanine compound, preferably a titanyl phthalocyanine compound or a hydroxygallium phthalocyanine compound, and more preferably a titanyl phthalocyanine compound, such as the Y-type, A-type (β-type), or the like, of titanyl phthalocyanine, having a characteristic main peak at the Bragg angle 2θ with respect to a Cu—Kα characteristic X-ray line (wavelength 1.54 Å). These oxy-titanyl phthalocyanines are disclosed in Jp-Tokukaihei-10-69107A. Further, the above-mentioned charge generating substances may be used singly or in combination of two or more kinds thereof, for example, the Y-type and the A-type, or in combination of the charge generating substances and polycyclic quinone, such as a perylene pigment.

As the binder for the charge generating layer, there can be used known resins, such as polystyrene resin, polyethylene resin, polypropylene resin, acrylic resin, methacrylic resin, vinyl chloride resin, vinyl acetate resin, polyvinylbutyral resin, epoxy resin, polyurethane resin, phenol resin, polyester resin, alkyd resin, polycarbonate resin, silicone resin, and melamine resin as well as copolymer resin including two or more of the above resins (e.g. vinyl chloride-vinyl acetate copolymer resin, vinyl chloride-vinyl acetate-maleic anhydride copolymer resin), and poly-vinylcarbazole resin. Of course, the binder resin for the charge generating layer is not limited to the above examples.

Preferably, the charge generating layer is formed by dispersing, with a dispersing machine, a charge generating substance in a solution prepared by dissolving a binder into a solvent, to thereby prepare a coating solution, applying the coating solution on a film by a coating machine such that the film has a predetermined film thickness, and then drying the coated film.

Examples of the solvent for dissolving the binder resin used for forming the charge generating layer include toluene, xylene, methylene chloride, 1,2-dichloroethane, methyl ethyl ketone, cyclohexadiene, ethyl acetate, butyl acetate, methanol, ethanol, propanol, butanol, methyl cellosolve, ethyl cellosolve, tetrahydrofuran, 1,4-dioxane, 1,3-dioxolan, pyridine, and diethylamine. Of course, the solvent is not limited to the above examples.

As for dispersing the charge generating substances, there can be used the ultrasonic wave dispersing machine, a ball mill, a sand grinder, a homomixer, etc., although the dispersing is not limited to the examples.

As the coating machine for forming the charge generating layer, there can be used an immersion coating machine, a ring coater, and the like, although the coating machine is not limited to the above machines.

Preferably, the mixing ratio of the charge generating substance to the binder resin is 1 to 600 parts by mass of the charge generating substance to 100 parts (hereinafter the term "parts" is intended to mean "parts by mass") of the binder resin, more preferably 50 to 500 parts of the former to 100 parts of the latter. It is preferable that the film thickness of the charge generating layer is 0.01 to 5 μm, though depending on characteristics of the charge generating substance, those of the binder resin, and the mixing ratio of the charge generating substance to the binder resin.

[Charge Transport Layer]

The charge transport layer contains a charge generating substance and a binder resin, and is formed by dissolving the charge generating substance in the binder resin solution, and applying the solution.

Examples of the charge generating substance include not only charge generating substances expressed by a general formula in Jp-Tokugan-2000-360998, but also a mixture of two or more of carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline compounds, oxazolone derivatives, benzimidazole derivatives, quinazoline derivatives, benzofuran derivatives, acridine derivatives, phenazine derivatives, aminostilbene derivatives, triarylamine derivatives, phenylenediamine derivatives, stilbene derivatives, benzidine derivatives, poly-N-vinylcarbazoles, poly-1-vinylpyrene, and poly-9-vinylanthracene.

As the binder resin for the charge transport layer, there can be used known resins, such as polycarbonate resin, polyacrylate resin, polyester resin, polystyrene resin, styrene-acrylonitrile copolymer resin, polymethacrylate resin, and styrene-methacrylate copolymer resin. Among them, polycarbonate resin is preferably used. Further, BPA (bisphenol A), BPZ (bisphenol Z), dimethyl BPA, BPA-dimethyl BPA copolymer, and the like are preferably used since they are excellent in suppressing generation of cracks, and have high wear resistance and favorable charging characteristics.

Preferably, the charge transport layer is formed by dissolving a binder resin and a charge transport substance into a solvent to prepare a coating solution, applying the coating solution by a coating machine to a predetermined film thickness, and then drying the film of the coating.

Examples of the solvent for dissolving the binder resin and the charge transport substance include toluene, xylene, methylene chloride, 1,2-dichloroethane, methyl ethyl ketone, cyclohexadiene, ethyl acetate, butyl acetate, methanol, ethanol, propanol, butanol, tetrahydrofuran, 1,4-dioxane, 1,3-dioxolan, pyridine, and diethylamine. Of course, the solvent is not limited to the above examples.

Preferably, the mixing ratio of the charge transport substance to the binder resin is 10 to 500 parts of the charge transport substance to 100 parts of the binder resin, more preferably 20 to 100 parts of the former to 100 parts of the latter.

Preferably, the film thickness of the charge transport layer is 10 to 100 μm, and more preferably 15 to 40 μm, though depending on characteristics of the charge transport substance, those of the binder resin, and the mixing ratio of the charge transport substance to the binder resin.

Further, an AO agent, an EA agent, a stabilizer, or the like may be added to the charge transport layer. As the AO agent, it is preferable to use an AO agent disclosed in Jp-Tokuganhei-11-200135. As the EA agent, it is preferable to use those disclosed in Jp-Tokukaisho-50-137543A, and Jp-Tokukaisho-58-76483A.

[Protective Layer]

In order to increase durability of the toner, a protective layer may be formed on the charge transport layer. As the binder resin for the protective layer, there can be used known resins, such as polycarbonate resin, polyacrylate resin, polyester resin, polystyrene resin, styrene-acrylonitrile copolymer resin, polymethacrylate resin, and styrene-methacrylate copolymer resin. There may be also used siloxane-based resins disclosed in Jp-Tokukaihei-09-190004A, Jp-Tokukaihei-10-095787A, and Jp-Tokukaihei-2000-171990A.

In the above, the most preferable layer structure of the organic photoconductor is exemplified. However, the organic photoconductor may comprise layer structures other than the above.

(5) Image Forming Method

Next, an image forming method according to the present invention will be described with reference to the drawings.

Figure 2:
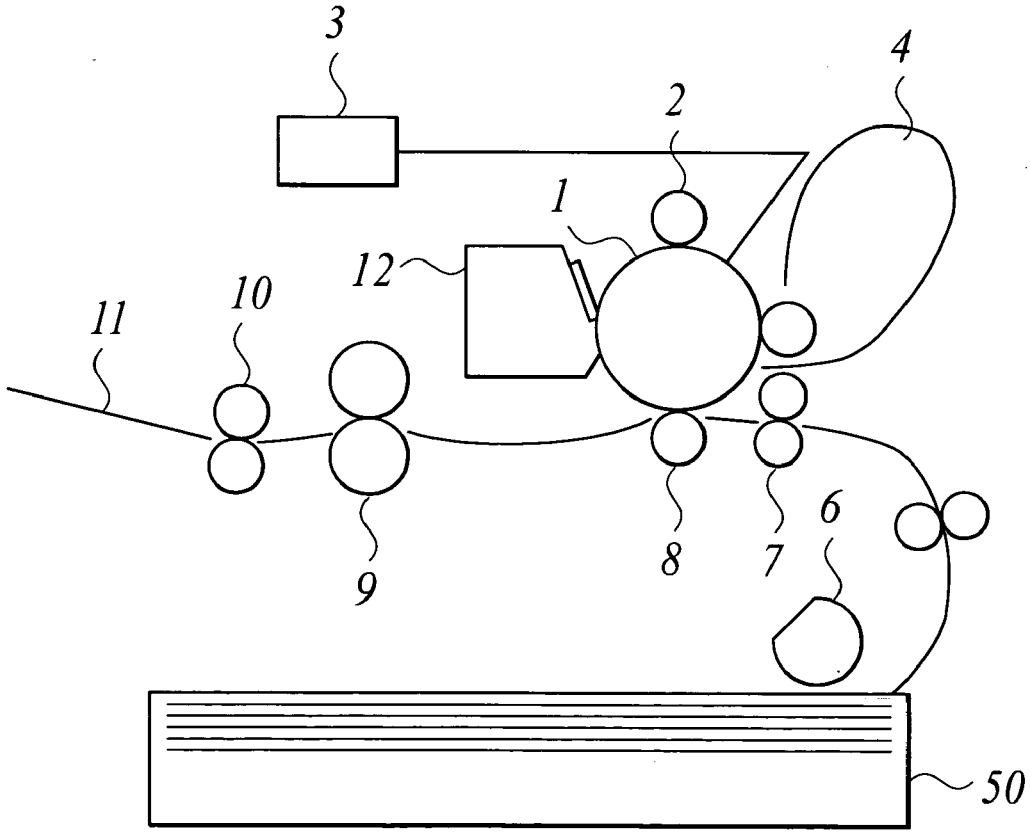
FIG. 2 is a diagram schematically showing the arrangement of an electrophotographic printer as an example of an image forming apparatus.

FIG. 2 shows the construction of an electrophotographic printer as one of the examples of the image forming apparatus.

In FIG. 2, reference numeral 1 designates an electrophotographic photoconductor drum, which has a photosensitive material, such as an organic photoconductor (OPC) or the like, formed on a substrate in the form of a cylinder or belt made of aluminum, nickel, or the like (the illustrated example has a cylindrical shape).

When an image is formed, first, uniform charging is carried out on the surface of the electrophotographic photoconductor drum 1 by an charging roller 2 of a charging section (charging step). Next, scanning and exposing are carried out by a laser scanner 3 of an exposure section, based on an image signal. The laser scanner 3 scans blinking of a semiconductor laser by using a polygon scanner, and irradiates a laser beam on the electrophotographic photoconductor drum 1. Whereby an electrostatic latent image is formed on the electrophotographic photoconductor drum 1 (latent image forming step). After that, the formed electrostatic latent image is developed by a developing unit 4 of developing section (developing step). For the development of the electrostatic latent image, jumping development, two-component development, FEED development, or the like is employed, and usually, in combination with reverse development in which the toner is attached to portions whose electric potential is reduced by the lighting of the laser.

A toner image formed by the development of the electrostatic latent image is transferred to a transfer material by an charging roller of a transfer section. The transfer material is contained in a cassette 5, and sent out one by one, by a paper feed roller 6. It should be noted that the transfer material is also referred to as a recording material, an image support, transfer paper, etc., normally plain paper is used as the transfer material, but it is not particularly limited in the kind of material so long as it is flat-shaped and allows a toner image to be transferred thereto by the transfer section.

Actually, when a print signal is received from a host computer, the transfer material is fed by the paper feed roller 6, and sent to the position of a transfer roller 8 of the transfer section by a timing roller 7 in synchronism with the print signal. At the position of the transfer roller 8, a toner image is transferred onto the transfer material by the transfer roller 8. The transfer roller 8 is formed by a conductive elastic body having a low hardness. The transfer roller 8 is a mechanism in which the transfer is electrostatically carried out by a bias electric field at a nip section formed by the electrophotographic photoconductor drum 1 and the transfer roller 8.

The toner image transferred on the transfer material is fixed by a fixing device 9 of the transfer section. Then, the transfer material is sent out of the apparatus by a exit roller 10, and exited to an exit tray 11.

On the other hand, toner which is not transferred but remains on the electrophotographic photoconductor drum 1 is cleaned by a blade of a cleaner 12 of a cleaning section (cleaning step).

Figure 3:
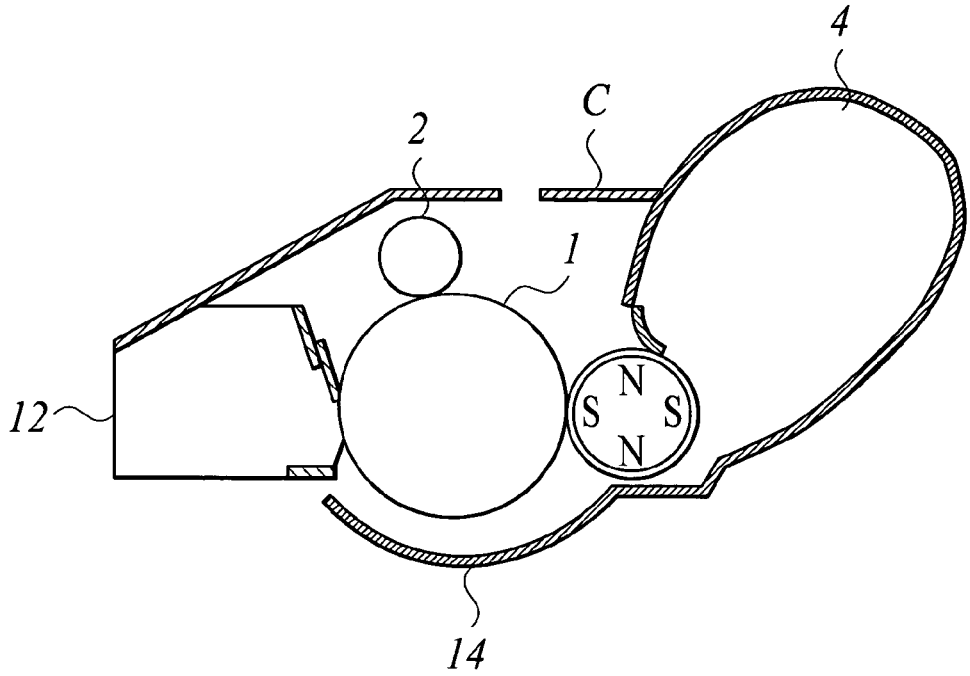
FIG. 3 is a sectional view schematically showing the construction of a process cartridge removably mounted in the image forming apparatus.

FIG. 3 is a sectional view schematically showing the construction of a process cartridge which is removable to (capable of being inserted into or removed from) the image forming apparatus in FIG. 2. The process cartridge C supports the electrophotographic photoconductor drum 1, the charging roller 2, the developing unit 4, and the cleaner 12. Further, the process cartridge C is provided with a shutter 14 for protecting the electrophotographic photoconductor drum 1. The process cartridge C is only required to include at least one of the electrophotographic photoconductor drum 1, which is an image carrier, the charging section, the developing section, the transfer section, and the cleaning section.

The process cartridge C is configured such that it is capable of freely driving the electrophotographic photoconductor drum for rotation, and further applying a desired voltage to the charging roller 2 using an external high-voltage power supply.

[Contact Charging Step]

The charging section may be based on corona charging, or may also be based on contact charging effected by direct contact with the electrophotographic photoconductor contact charging method. The contact charging has the merit of generating a reduced amount of ozone.

As the contact charging section, which is preferable for the charging step, there can be employed various charging members such as a magnetic brush type, an charging roller type, a blade type, a brush charging type, and the like. Among them, the charging members of the charging roller type and the magnetic brush type are preferable since they make it easy to obtain uniformity of charging. In the following, the charging by the charging roller type and the magnetic brush type will be described in detail.

[Charging Roller]

In the charging step, it is possible to bring an charging roller formed by a conductive elastic member into contact with a electrophotographic photoconductor (image carrier) to apply a voltage to the charging roller, thereby electrically charging the electrophotographic photoconductor.

Figure 4:
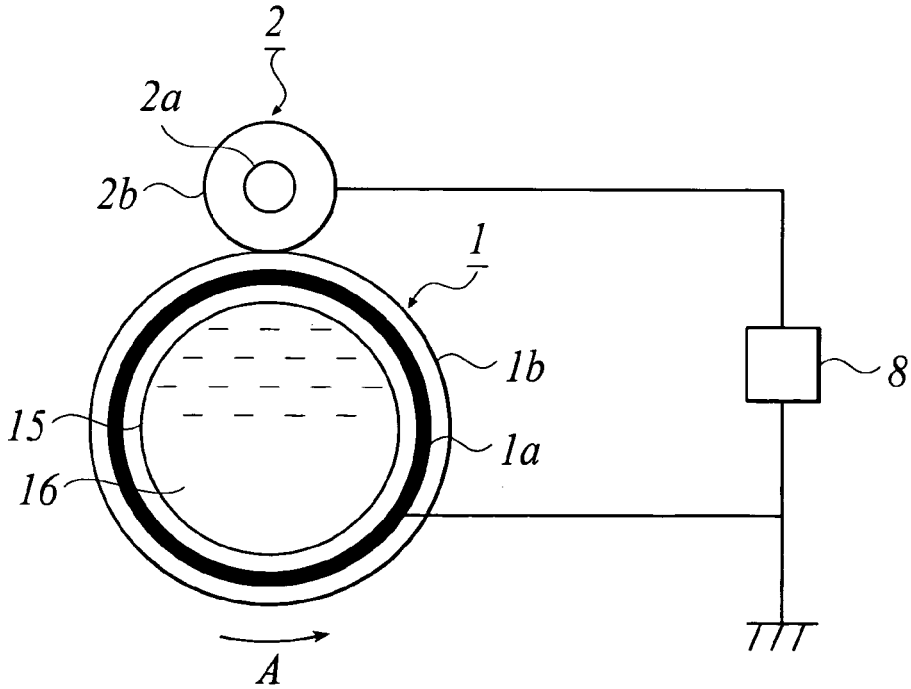
FIG. 4 is a diagram schematically showing one form of a charging roller as a contact charging section.

FIG. 4 shows the construction of an electrophotographic photoconductor drum as a body for electrostatic charging, and an charging roller as the contact charging section.

In FIG. 4, reference numeral 1 designates the electrophotographic photoconductor drum, which is comprised of a grounded conductive substrate 1*a* made of aluminum having a thickness of 1 mm, and an organic photosensitive layer 1*b* formed on the outer peripheral surface of the substrate 1*a*. The photoconductor drum 1 has an outer diameter of 30 mm, and is driven for rotation in a direction indicated by an arrow in FIG. 4 at a predetermined peripheral velocity.

Reference numeral 2 designates the charging roller. The charging roller comprises a conductive core metal 2*a* made of an SUS (Steel Use Stainless; JIS), and a conductive elastic layer 2*b* formed on the outer peripheral surface of the conductive core metal 2*a* and made of polyurethane rubber containing carbon. The charging roller 2 has an outer diameter of 12 mm. Further, the charging roller 2 is brought into pressure contact with the surface of the electrophotographic photoconductor drum 1 by spring members, which is not shown, at opposite ends in the direction of the length of the conductive core metal 2*a* (in a direction perpendicular to the page of FIG. 2). Accordingly the charging roller 2 is driven for rotation.

When a predetermined voltage is applied to the charging roller 2 by a high-voltage power supply 8, the surface of the electrophotographic photoconductor drum 1 is charged to a predetermined potential. Preferably, the voltage applied to the charging roller 2 is an oscillation voltage obtained by superimposing the AC voltage on the DC voltage. The term "oscillation voltage" is intended to mean a voltage whose voltage value periodically varies with the lapse of time.

It is preferable for purposes of obtaining uniformity of charging that the oscillation voltage has a peak-to-peak voltage two or more times as high as a voltage at the start of charging the surface of the electrophotographic photoconductor drum 1 by applying only the DC voltage to the charging roller 2. Further, the waveform of the oscillation voltage is not limited to a sinusoidal waveform, but it may be may be a rectangular waveform, a triangular waveform or a pulse waveform, but the sine waveform which does not contain harmonic components is preferable from the viewpoint of preventing charging noises. Furthermore, the waveform of the oscillation voltage may be that of the pulse waveform which is formed by turning on and off the DC voltage.

For the charging roller type, there may be employed any of a DC charging method of applying the DC voltage to the roller, and an induction charging method of applying the AC voltage to the roller.

The frequency f of the voltage applied in the dielectric charging method may be optionally chosen, and to prevent strobing, i.e. stripes, an appropriate frequency can be chosen according to the relative speed of the conductive elastic roller and the image carrier. This relative speed may be determined by the size of the contact area between the conductive elastic roller and the image carrier.

The conductive elastic roller comprises a core metal and a layer of a conductive elastic member (also simply referred to as "the conductive elastic layer" or "the conductive rubber layer") coated around the core metal.

Examples of a rubber composition usable for forming the above conductive rubber layer include polynorbornene rubber, ethylene-propylene rubber, chloroprene rubber, acrylonitrile rubber, silicone rubber, and so forth. These rubbers can be used singly or in the form of a mixture rubber comprised of two or more of them.

To add conductivity to the above rubber composition, the rubber composition is blended with an electrical conductivity additive. Examples of suitable electrical conductivity additives include known carbon black (furnace carbon black or Ketjen black), metal powders of tin oxide and the like. The correct amount of the conductivity additive used is 5 to 50 parts per 100 parts of the whole amount of the rubber composition.

In addition to a rubber substrate, a foaming agent, and the conductivity additive, a rubber chemical and a rubber additive may be blended in the rubber composition to form an electrically conductive foam rubber composition. As the rubber chemical and the rubber additive, there can be used vulcanizing agents, such as sulfur and peroxide, vulcanizing assistants, such as hydrozincite and stearic acid, vulcanization accelerators, such as a sulfenamide-based vulcanization accelerator, a thiuram-based vulcanization accelerator, a thiazole-based vulcanization accelerator, and a guanidine-based vulcanization accelerator, antiaging agents, such as an amine-based antiaging agent, a phenol-based antiaging agent, a sulfur-based antiaging agent, and a phosphorus-based antiaging agent, as well as antioxidant agents, ultraviolet ray absorbers, ozone deterioration inhibitors, and adhesion additives. Further, various kinds of reinforcing agents, friction-coefficient regulating agents, and inorganic fillers, such as silica, talc, and clay, can be selectively used as desired. Preferably, the conductive rubber layers have DC specific volumetric resistance within a range of $10^3$ to $10^7$ Ω·cm.

Further, in order to prevent toner or the like remaining on the surface of the electrophotographic photoconductor from adhering to the charging member, a releasing coating layer may be formed on the outer surface of the conductive elastic layer. The coating layer has functions of preventing oil from oozing from the elastic layer, and eliminating unevenness of resistance of the elastic layer to make the resistance of the elastic layer can be made uniform, protecting the surface of the charging roller, adjusting the hardness of the charging roller, and so forth.

The coating layer may be made of any type insofar as it satisfies the requirement of the above physical properties, and may have a one layer structure or a multilayer structure. As the materials, hydrin rubber, polyurethane rubber, and resins, such as nylon, polyvinylidene fluoride, and polyvinylidene chloride can be cited. Further, it is preferable that the coating layer has a thickness of 100 to 1000 μm, and a resistance value of $10^5$ to $10^9$ Ω·cm. Preferably, the resistance value of the coating increases toward the its outer surface. To adjust the resistance of the coating layer, a method may be employed in which a conductive substance, such as carbon black, a metal, and a metal oxide is caused to be contained therein.

To adjust the surface roughness Rz of the charging roller, it is preferable to cause powder to be contained in the surface layer (conductive elastic layer or coating layer) of the charging roller. Although the powder to be used may be any of inorganic and organic powders, it is particularly preferable to use a silica powder when the inorganic powder is used.

As the organic powder, there can be used urethane resin particles, nylon particles, silicone rubber particles, epoxy resin particles, and so forth. These resins may be used singly or in a mixture of two or more kinds thereof. A suitable powder may be selected from substances which can adjust the surface roughness Rz of the surface layer to a range of 0.05 to 10.0 μm. However, it is easy to attain a desired range of the surface roughness, when the particle size of a powder is in a range of 1 to 20 μm. If the particle size of a powder exceeds 20 μm, the surface roughness Rz as well exceeds 10.0 μm, which prevents the desired goal from being attained. Inversely, when the particle size of a powder is smaller than 1 μm, the surface roughness Rz of the powder is liable to be smaller than 0.05 μm, which also prevents the desired goal from being attained.

The preferable range of the surface roughness Rz is between 0.05 to 10.0 μm, since the filming of the toner on the surface of the roller is markedly exhibited when the surface roughness Rz exceeds 10.0 μm, whereas when the surface roughness Rz is smaller than 0.05 μm, adhesiveness between the charging roller and the electrophotographic photoconductor drum is increased to increase a contact area therebetween, whereby it is impossible to suppress charging noises.

It is preferred that the amount of a powder contained in the surface layer is 5 to 20 parts per 100 parts of a resin, and the powder is dispersed.

The charging roller can be manufactured e.g. in the following manner: First, a rotational shaft (core metal) made of metal is placed in a mold having a cylindrical molding space, a material for forming a conductive elastic body layer is filled in the mold, and the conductive elastic body layer is formed around the outer peripheral surface of the rotational shaft by carrying out vulcanization. Then, the rotational shaft having the conductive elastic body layer formed on the outer peripheral surface thereof is taken out. On the other hand, a material, such as a urethane resin or the like, a powder, a conductivity additive, and other additives are blended, and the blend is mixed and stirred e.g. by using a ball mill to thereby prepare a mixture of materials for forming a surface layer. Then, this mixture is coated on the surface of the rotational shaft having the conductive elastic body layer by a dip method, a roll coating method, or a spray coating method, to a uniform thickness, dried, and heated for curing. Thus, an charging roller with a two-layer structure can be manufactured.

Preferably, the charging roller obtained as above is formed such that the surface roughness Rz of the surface layer thereof, which is the outermost layer of the roller, is in a range of 0.05 to 10.0 μm.

A bias voltage comprised of a DC component and an AC component is applied to the charging roller 2 (and the transfer roller 8) appearing in FIG. 2 from the power supply, whereby the electrophotographic photoconductor drum 1 is charged, and a toner image is transferred to a transfer material in a state where a very small amount of ozone is generated. The bias voltage is comprised of a DC bias of ±500 to 1000 V under normal conditions, and an AC bias of 100 Hz to 10 kHz, 200 to 3500 V (p-p), superimposed on the DC bias.

The charging roller 2 and the transfer roller 8 are driven or forced for rotation by being brought into pressure contact with the electrophotographic photoconductor drum 1.

The pressure contact with the electrophotographic photoconductor drum 1 is set to a range of 0.10 to 1.0 N/cm, and the rotational speed of the roller is set to be once to eight times as fast as the peripheral velocity of the photoconductor drum 1.

The charging roller 2 (and the transfer roller 8) is/are comprised of a core metal, and a rubber layer which is formed on the outer periphery of the core metal as a conductive elastic member made of chloroprene-rubber, urethane rubber, silicone rubber, or the like, or alternatively a sponge layer formed of the same. Preferably, the charging roller 2 (and the transfer roller 8) is/are configured to have a protective layer formed by a releasing fluorocarbon resin or silicone resin having a thickness of 0.01 to 1 μm, at the outermost layer thereof.

[Magnetic Brush]

Figure 5:
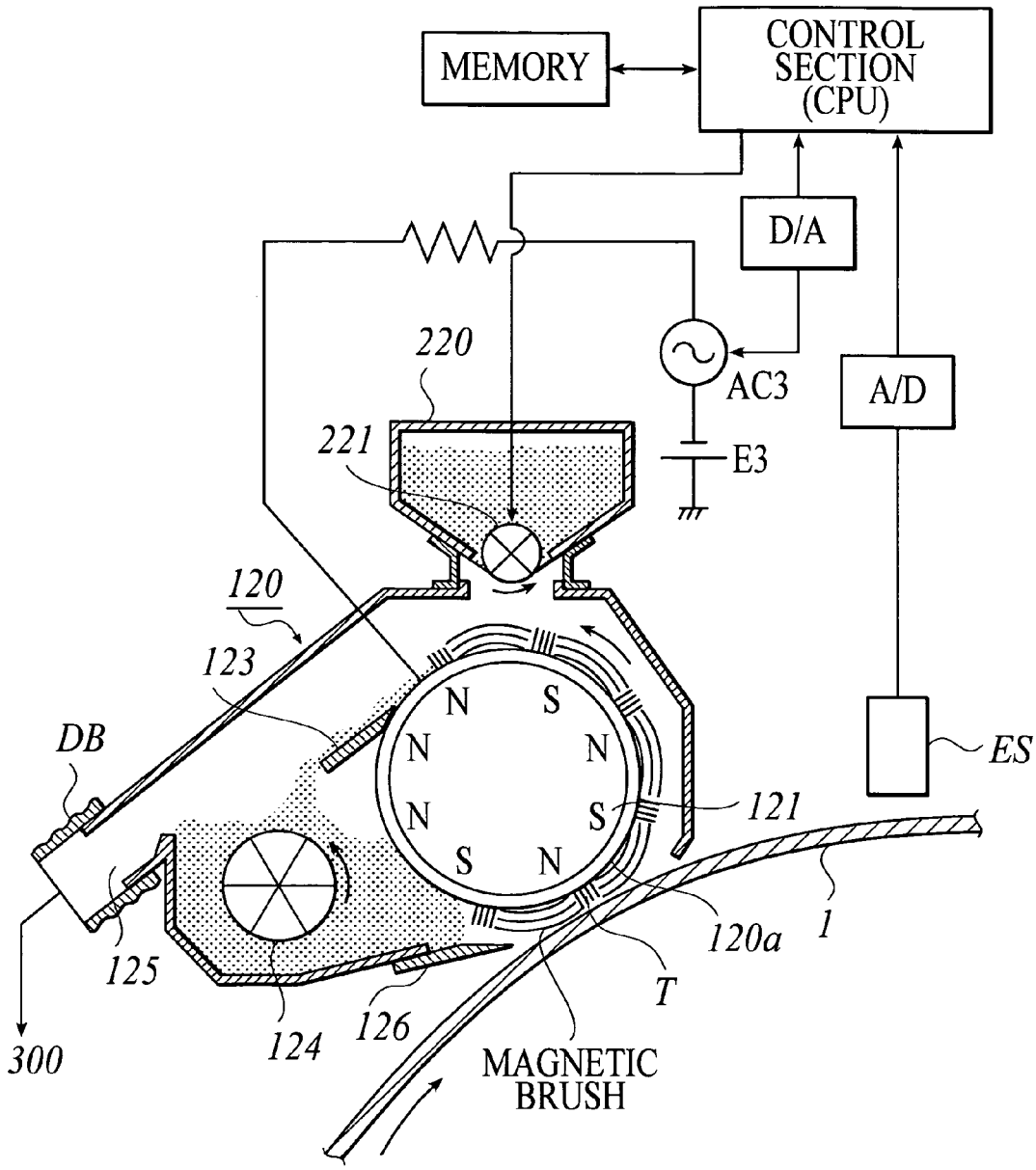
FIG. 5 is a diagram showing the arrangement of a magnetic brush charging device.
Figure 6:
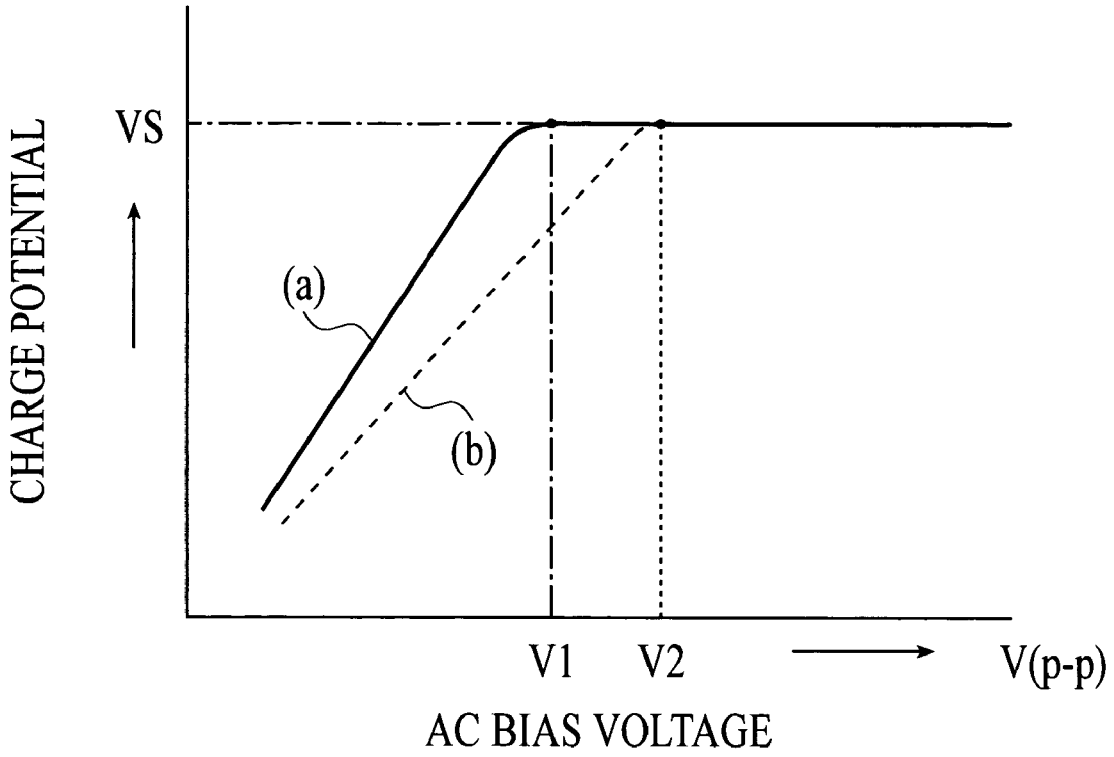
FIG. 6 is a diagram showing the relationship between an AC bias voltage applied by the charging device and a charge potential.

FIG. 5 shows the arrangement of a contact-type magnetic brush charging device, and FIG. 6 shows the relationship between an AC bias voltage applied by the charging device appearing FIG. 5, and a charge potential.

In general, when the volume average particle size of magnetic particles forming the charging magnetic brush is large, napping of the magnetic brush formed on a charging magnetic particle conveyer (carrier) is made rough, so that even if the photoconductor drum is charged while being vibrated by an electric field, unevenness of the magnetic brush is liable to occur, which brings about the problem of unevenness of charging. To solve this problem, it is only required to reduce the volume average particle size of magnetic particles. As the results of experiments, the desired effect starts to be produced when the volume average particle size is reduced to 200 μm or less. Particularly, when the volume average particle size is reduced to 150 μm or less, no problem is actually brought about by the roughness of napping of the magnetic brush. However, when the particles become too small in size, they are made liable to adhere to the surface of the electrophotographic photoconductor drum during charging or fly without adhering to the surface. Although this phenomenon is related to the strength of the electric field acting on the particles, and the intensity of magnetization of the particles, in general, it markedly occurs when the volume average particle size of the particles is reduced to 20 μm or less.

From the above, it is preferable that the volume average particle size of the magnetic particles not larger than 200 μm and not smaller than less and 20 μm or more, and the magnetic particles having particle sizes equal to or smaller than a half of the number average particle size of the magnetic particles are equal to or smaller than 30% in number. The intensity of magnetization employed is preferably $3.75\times10^{-5}$ to $12.5\times10^{-5}$ wb·m/kg.

The above magnetic particles can be obtained by subjecting particles of any of ferromagnetic substances, which are the same as those described above as the magnetic materials of the magnetic carrier particles of the conventional two-component developing agent, including metals of iron, chromium, nickel, cobalt, and the like, and compounds and alloys of these, such as triiron tetroxide, γ-ferric oxide, chromium dioxide, manganese monoxide, ferrite, manganese-copper based alloys, or alternatively particles obtained by coating surfaces of the above magnetic substance particles with a resin, such as a styrene resin, a vinyl resin, a ethylene resin, a rosin-modified resin, an acrylic resin, a polyamide resin, an epoxy resin, a polyester resin, or the like, or resin particles obtained by producing resins containing dispersed magnetic substance fine particles, to particle size selection by the conventionally known average particle size selection.

Further, if magnetic particles are formed into a spherical shape, it is also possible to obtain advantageous effects that a particle layer formed on the carrier can be made uniform, and further a high bias voltage can be uniformly applied to the carrier. More specifically, the spherical shape of magnetic particles produces the following advantageous effects: (1) In general, magnetic particles are more easily magnetically attracted in the longitudinal direction thereof. However, the directional property is eliminated by forming the particles into a spherical shape. Therefore, the magnetic particle layer is uniformly formed, thereby making it possible to prevent occurrence of locally low-resistance regions and unevenness of the layer thicknesses. (2) As magnetic particles come to have a higher resistance, edge portions existing in the conventional particles are eliminated to prevent concentration of an electric field to the edge portion. As a consequence, even if a high bias voltage is applied to the carrier of the charging magnetic particles, the discharge occurs uniformly over the surface of the electrophotographic photoconductor drum, whereby unevenness of charging can be prevented.

As the spherical particles which produce the advantageous effects as described above, conductive magnetic particles are preferable which are formed such that they have a resistivity in a range between $10^5$ to $10^{10}$ Ω·cm. This value of resistivity is obtained by filling particles in a vessel having a cross-sectional area of 0.50 $cm^2$ for tapping, then placing a load of 1 $kg/cm^2$ on the particles, and reading a current value produced when a voltage generating an electric field of 1000 V/cm is applied between the load and a bottom electrode. If the resistivity is low, when a bias voltage is applied to the carrier, electric charge is injected into the magnetic particles, so that the magnetic particles become liable to adhere to the surface of the electrophotographic photoconductor drum, and the electrophotographic photoconductor drum becomes easy to undergo dielectric breakdown due to the bias voltage. On the other hand, if the resistivity is high, the electric charge injection does not occur to prevent the magnetic particles from being charged.

Further, it is desirable that magnetic particles used for the contact-type magnetic brush charging device have a small specific gravity and an appropriate maximum magnetization so as to cause the magnetic brush formed by the magnetic particles to be swiftly moved by a vibrating electric field, and moreover inhibit the particles from flying out. More specifically, it has been found that satisfactory results can be obtained by using magnetic particles having a true specific gravity of 6 or less, and a maximum magnetization of $3.75\times10^{-3}$ to $12.5\times10^{-5}$ wb·m/kg.

With the above all things considered, it is desirable that magnetic particles are made spherical in shape such that the ratio of a major axis to a minor axis of each magnetic particle is at least three or less, they have no projections, such as needle-like portions and edge portions, and their resistivity is preferably in a range between $10^5$ to $10^{10}$ Ω·cm. Such spherical magnetic particles are manufactured by selecting as spherical substance particles as possible, by carrying out making-spherical treatment after forming dispersed resin particles using as fine magnetic substance particles as possible, in the case of particles of a magnetic substance fine particle-dispersed system, or by forming dispersed resin particles by a spray dry method.

Referring to FIG. 5 and FIG. 6, the magnetic brush charging device 120 as the charging section is comprised of a cylindrical charging sleeve 120*a* which is made e.g. of an aluminum material or a stainless material, as a charging magnetic particle carrier arranged in a manner opposed to the rotating electrophotographic photoconductor drum 1, such that it rotates at a location (charging location T) close to the electrophotographic photoconductor drum rotation 1 toward the same side (in the counterclockwise direction in the case of the sleeve 120*a*) as the side toward which the photoconductor drum 1 rotates (in the clockwise direction in the case of the photoconductor drum 1), a magnet body 121 disposed in the charging sleeve 120*a* and having north poles and south poles, a magnetic brush of magnetic particles formed on the outer peripheral surface of the charging sleeve 120*a* by the magnet body 121, for charging the electrophotographic photoconductor drum 1, a scraper 123 for scraping off magnetic particles of the magnetic brush on the charging sleeve 120*a* at an N-N magnetic pole portion of the magnet body 121, a stirring screw 124 for stirring magnetic particles in the magnetic brush charging device 120, or causing used magnetic particles to flood from an exit 125 of the magnetic brush charging device 120 for discharging the same when new magnetic particles are supplied, and a nap-regulating plate 126 for regulating the nap of the magnetic brush. Preferably, the charging sleeve 120*a* is rotatable with respect to the magnet body 121 such that it is rotated at a location opposed to the electrophotographic photoconductor drum 1 in the same direction (counterclockwise direction in the case of the charging sleeve 120*a*) as the direction of movement of the photoconductor drum 1, at a peripheral velocity 0.1 to 1.0 times as fast as that of the electrophotographic photoconductor drum 1. Further, as the charging sleeve 120*a*, there is used an electrically conductive carrier to which a charging bias voltage can be applied. Particularly, an electrically conductive carrier is preferably used which is configured to contain a magnet body 121 having a plurality of magnetic poles provided inside the conductive charging sleeve 120*a* on the surface of which a particle layer is formed. In the carrier constructed as above, the magnetic particle layer formed on the surface of the conductive charging sleeve 120*a* moves with an undulation caused by relative rotation of the sleeve 120*a* with respect to the magnet body 121. Therefore, even when the magnetic particle layer formed on the surface of the conductive charging sleeve 120*a* has a little unevenness in layer thickness due to successive supply of new magnetic particles, an adverse influence of the unevenness of the layer thickness is sufficiently accommodated by the undulation of the magnetic particle layer, so that no actual problem is brought about. Preferably, the surface of the conductive charging sleeve 120*a* has an average surface roughness of 5.0 to 30 μm, so as to stably carry magnetic particles. This is because an extremely smooth surface of the sleeve 120*a* makes it impossible to carry a sufficient amount of magnetic particles, whereas an extremely rough surface of the sleeve 120*a* causes an overcurrent to flow from convex portions of the surface. In both of the cases, uneven charging is liable to occur. To obtain the required surface roughness, the sandblast treatment is preferably employed. Preferably, the charging sleeve 120*a* has an outer diameter of 5.0 to 20 mm. This makes it possible to secure a contact region required for charging. If the contact region is too large, an extremely large charging current is caused to flow, whereas if the contact region is too small, unevenness of charging is made liable to occur. Further, when the charging sleeve 120*a* is caused to have a small outer diameter as described above, magnetic particles are made liable to fly out or attach to the electrophotographic photoconductor drum 1 by centrifugal force. Therefore, it is preferable that the linear velocity of the charging sleeve 120*a* is almost the same as, or slower than the moving velocity of the electrophotographic photoconductor drum 1.

Further, it is preferable that the magnetic particle layer formed on the surface of the charging sleeve 120*a* has a uniform thickness after sufficiently scraping off magnetic particles by regulation. When the amount of magnetic particles existing in the charging region on the surface of the charging sleeve 120*a* is too large, the magnetic particles are not sufficiently vibrated, thereby causing abrasion of the electrophotographic photoconductor and unevenness of charging, and making an overcurrent liable to flow to increase drive torque of the charging sleeve 120*a*. Inversely, when the amount of magnetic particles existing in the charging region on the surface of the charging sleeve 120*a* is too small, there occurs a portion whose contact with the electrophotographic photoconductor drum 1 is incomplete. This causes attachment of the magnetic particles to the electrophotographic photoconductor drum 1 or unevenness of charging. After conducting many experiments, it has been found that the amount of adhering magnetic particles in the charging region is preferably 100 to 400 $mg/cm^2$, particularly preferably 200 to 300 $mg/cm^2$. It should be noted that the above amount of the adhering magnetic particles is an average value in the charging region of the charging brush.

A peripheral surface of the electrophotographic photoconductor drum 1 is brought into sliding contact with the charging sleeve 120*a* of the magnetic brush charging device 120 for charging the electrophotographic photoconductor drum 1. To the charging sleeve 120*a* is applied a charging bias obtained by superimposing an AC bias AC3 on a DC bias E3 as required. In this case, for example, as the DC bias E3 is used a voltage between −100 to −500 V, having the same polarity (minus polarity in the present embodiment) as the toner, and as the AC bias AC3 is used a voltage between 300 to 500 V(p-p) with a frequency of 1 to 5 kHz. Between the charging sleeve 120*a* and the electrophotographic photoconductor drum 1, there is formed a vibrating electric field by application of the voltage of the above AC bias AC3, so that an electric charge is smoothly injected from the magnetic brush to the electrophotographic photoconductor, whereby a uniform high-speed charging is performed.

The magnetic brush on the charging sleeve 120*a*, after having charged the electrophotographic photoconductor drum 1, is dropped from the charging sleeve 120*a* by the scraper 123 at the N-N magnetic pole portion provided in the magnet body 121, and stirred by the stirring screw 124 rotating at a portion close to the charging sleeve 120*a* toward the opposite side (in the counterclockwise direction) to the side toward which the charging sleeve 120*a* rotates (in the counterclockwise direction), After that, the magnetic brush is formed again and carried to the charging portion T As shown in FIG. 6, the relationship between a peak-to-peak voltage V(p-p) of the AC bias AC3 in the charging bias and the charge potential is characterized in that as the peak-to-peak voltage V(p-p) is increased, the charge potential is increased, and the charge potential is saturated at a value approximately equal to a value VS of the DC bias E3 in the charging bias at a fixed peak-to-peak voltage V(p-p) of V1, and hardly changes even if the peak-to-peak voltage V(p-p) is made larger than the fixed voltage V1. While the electric resistance of magnetic particles is changed depending on environmental conditions, it is increased e.g. due to fusion of toner to surfaces of magnetic particles as the magnetic particles are used. Therefore, a characteristic curve of newly used magnetic particles is positioned on a left side as indicated by a solid line (a), whereas a characteristic curve of magnetic particles after a long-term use is positioned on a right side as indicated by a dotted line (b).

In the contact-type charging device for the image forming apparatus, the voltage value of the DC bias E3 corresponding to the charge potential is set to a predetermined value when the power is turned on, or before printing operation is started, and a charging bias obtained by progressively increasing the peak-to-peak voltage V(p-p) of the AC bias AC3 from a low value is applied. An electrometer ES detects changes in the charge potential of the electrophotographic photoconductor drum 1 occurring at this time. The detected charge potential is converted to a digital value by an A/D converter, and then inputted to a control section (CPU). The control section defines the value of the peak-to-peak voltage V(p-p) obtained when the charge potential has reached a saturation point, i.e. the predetermined value VS, as a proper bias value V1, and instructs printing operation.

More specifically, when the printing operation is to be carried out, the value V1 of the V(p-p) of the AC bias AC3 is determined by progressively increasing (sweeping) the AC bias AC3 from a low value, and a bias signal is outputted from the control section. After converted to an analog value by a D/A converter, this control signal is delivered to the AC bias AC3, which outputs the determined peak-to-peak voltage value V1. At this time, a predetermined value V2 stored in a memory for execution of replacement of deteriorated magnetic particles is red out, and compared with the value of the peak-to-peak voltage V1. The resistance of magnetic particles is increased as the toner is mixed therein, so that the proper bias value V1 is increased as the magnetic particles are used for printing operation. When the proper bias value V1 is increased, the peak-to-peak voltage V(p-p) to be applied to the DC bias E3 is also increased, thereby causing a state incapable of charging. Image forming operation is continued so long as the measured value is smaller than the predetermined value V2 indicative of incapability of charging, but when the measured value is larger than the predetermined value V2, the control section delivers a signal for stopping the image forming operation, whereby the image forming operation is stopped, and a failure of the charging device is displayed in a display of an operation section, not shown. In response to the display, a supply bottle 220 for supply of charging magnetic particles to the charging device 120 is set in the magnetic brush charging device 120, and a lid, not shown, formed in the bottom of the supply bottle 220 is opened to drop and supply the magnetic particles in the magnetic brush charging device 120. Although in the above description, the electrometer ES is used to detect the charge potential of the electrophotographic photoconductor drum 1, this is not limitative, but there may be used a method in which a DC ammeter is connected to a bias power supply to change the AC bias V(p-p), and the peak-to-peak voltage V(p-p) obtained when the current value has reached a saturation point is defined as a proper bias value V1, whereby the proper bias value V1 and the predetermined value V2 are compared with each other so as to supply magnetic particles when the predetermined value V2 exceeds the value V1.

Further, during maintenance of the image forming apparatus, or periodically upon execution of 50000 times of printing operations, charging magnetic particles are replaced. Whenever printing operation is performed for maintenance according to data stored in the memory, or periodically e.g. upon execution of 50000 times of printing operations, the control section delivers a magnetic particle-replacing signal. In response to the magnetic particle-replacing signal, a drive motor, not shown, is driven for rotating a supply roller 221 disposed in the supply bottle 220 set in advance, whereby the whole amount of magnetic particles within the supply bottle 220 is dropped into the magnetic brush charging device 120 by one operation. The control may be provided such that after supply of the magnetic particles, removal of the empty supply bottle 220 and setting of a new supply bottle 220 places the image forming apparatus in an operative state. Further, when the periodic supply of magnetic particles is executed, magnetic particles may be supplied in the following manner: The control section displays a supply signal at the operation section, not shown, e.g. by flashing of a lamp or the like, and a supply bottle 220 is sets in the magnetic brush charging device 120, and then the lid, not shown, formed in the bottom surface of the supply bottle 220 is opened to supply the magnetic particles.

The dropped magnetic particles are carried by the rotated charging sleeve 120*a*, scraped off the surface of the charging sleeve 120*a* by the scraper 123, and supplied to the bottom of the magnetic brush charging device 120. Then, used magnetic particles contained in the magnetic brush charging device 120 are caused to flood from the exit 125 by the stirring screw 124 rotated counterclockwise, and collected through a duct DB by a magnetic particle-collecting container 300 in common use. At this time, it is preferable that the amount of magnetic particles supplied from the supply bottle 220 to the magnetic brush charging device 120 by one operation is 20 to 50 mass % with respect to all the magnetic particles to be contained in the magnetic brush charging device 120. If the amount is smaller than 20 mass %, the amount of newly supplied magnetic particles is too small so that replacing effect cannot be obtained, which prevents excellent charging from being performed, whereas if the amount is larger than 50 mass %, new magnetic particles flood from the exit.

According to the charging device described above, it is possible to maintain an excellent charging performance for a long time period, without deteriorating magnetic particles in the charging device.

[Developing Step]

Next, a description will be given of the developing agent and developing conditions used in the developing step.

Although the toner may be used both for a single-component developing agent and a two-component developing agent, it is preferably used for a two-component developing agent.

When the toner is used for the single-component developing agent, the toner as it is may be directly used as a nonmagnetic single-component developing agent, but normally it is used as a magnetic single-component developing agent by causing magnetic particles having a volume average particle size of approximately 0.1 to 5 μm to be contained in toner particles. As the method of causing magnetic particles to be contained in the toner, there is generally employed a method of causing magnetic particles to be contained in nonspherical toner particles, similarly to the colorant.

Further, the toner can be used for the two-component developing agent, by mixing the same with a carrier. In this case, as magnetic particles of the carrier, there are used conventionally known materials, such as metals including iron, ferrite, and magnetite, and alloys of these metals with aluminum, lead, and the like. Particularly, ferrite particles are preferably used. The magnetic particles have a volume average particle size of 15 to 100 μm, and preferably 25 to 60 μm.

Typically, the volume average particle size of a carrier can be measured by "HELOS" (available from SYMPATEC Corp.), which is a laser diffraction-type particle size distribution measuring apparatus equipped with a wet-type dispersion machine.

The carrier is preferably one having magnetic particles further coated with a resin, or a so-called resin dispersion-type carrier having magnetic particles dispersed in a resin. Although the composition of the resin for coating the magnetic particles is not particularly limited, there can be used e.g. olefin resin, styrene resin, styrene-acrylic resin, silicone resin, ester resin, fluorine-containing polymer resin, etc. Further, although the resin for forming the resin dispersion-type carrier is not particularly limited, there can be used known resins, such as styrene-acrylic resin, polyester resin, fluorine resin, and phenol resin.

Further, as the development method, there can be used both a contacting development method and a non-contacting development method. When the non-contacting development method is employed, it is possible to perform normal development by non-contacting development, and reversal development by non-contacting development. The absolute value of a DC developing electric field is $1\times10^3$ to $1\times10^5$ V/cm, preferably, $5\times10^3$ to $10^4$ V/cm. If the absolute value of the DC developing electric field is smaller than $10^3$ V/cm, underdevelopment is caused, resulting in an insufficient image density, whereas if the absolute value exceeds $10^5$ V/cm, the image quality becomes coarse, causing fogging of the image.

As to the AC bias, the voltage thereof is between 0.5 to 4 kV(p-p), preferably between 1 to 3 kV(p-p), while the frequency thereof is between 0.1 to 10 kHz, preferably between 2 to 8 kHz. If the voltage of the AC bias is smaller than 0.5 kV(p-p), toner particles adhering to the carriers are not released to cause insufficient non-contacting development, which results in an insufficient image density. Further, if the voltage of the AC bias exceeds 4 kV(p-p), carriers in the developing agent fly to be attached to the electrophotographic photoconductor. Further, if the frequency of the AC bias is lower than 0.1 kHz, the release of toner particles from the carriers becomes insufficient, which results in underdevelopment and lowered image density. Further, if the frequency of the AC bias exceeds 10 kHz, the toner cannot follow up changes in the electric field, which causes defective development to lower image density.

[Cleaning Step]

Although there are a large number of cleaning methods, at present, a cleaning blade method is used in almost all the cases. In this method, the cleaning can be performed under a wide range of conditions, and exhibit stable cleaning characteristics. However, due to the use of a rubber blade which is pressed against the electrophotographic photoconductor, there sometimes occur vibrations and unusual noise, and curling of blade is liable to occur.

For example, in the image forming apparatus shown in FIG. 2, after the transfer of an image, a cleaning device 12 corresponding to the cleaning section is brought into pressure contact with the electrophotographic photoconductor drum 1, thereby cleaning the photoconductor drum 1, and makes the same ready for a next image forming operation.

In this case, a wide range of cleaning blades can be used as the cleaning blade irrespective of a material thereof, so long as they have rubber elasticity. Of these blades, a blade made of polysilicone or polyurethane, particularly, the blade made of polyurethane is preferable.

[Color Image Forming Method]

Figure 7:
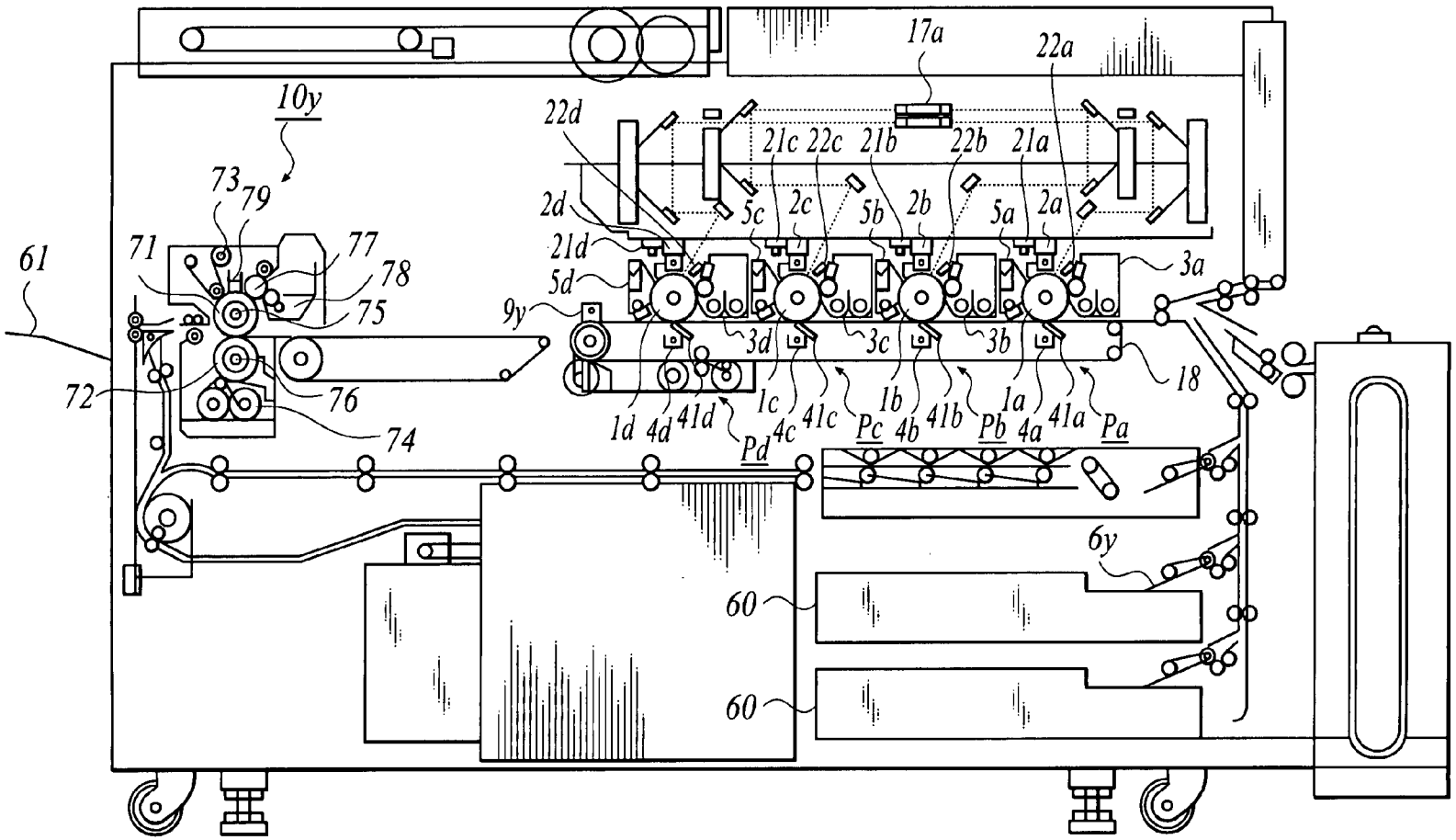
FIG. 7 is a diagram showing the arrangement of a color copying machine.

FIG. 7 is a diagram schematically showing one of examples of the color image forming apparatus.

A color electrophotographic image forming apparatus has a body having first, second, third, and fourth image forming sections Pa, Pb, Pc, and Pd arranged in parallel with each other. The image forming sections have the same construction, and form respective visible images (toner images) of different colors.

The image forming sections Pa, Pb, Pc, and Pd include respective dedicated electrostatic latent image carriers (electrophotographic photoconductor drums) 1*a*, 1*b*, 1*c*, and 1*d*. Images on the electrophotographic photoconductor drums 1*a*, 1*b*, 1*c*, and 1*d*, formed by the respective image forming sections Pa, Pb, Pc, and Pd are transferred onto a recording material (also referred to as a "transfer material") which is carried by a recording material carrier 18 moved along a path adjacent to the image forming sections. Further, the images transferred onto the recording material are fixed by a fixing section (fixing device) 10*y* by being heated under pressure, and the recording material is exited onto a tray 61.

Next, a latent image forming section of each image forming section will be described. Around the peripheries of the electrophotographic photoconductor drums 1*a*, 1*b*, 1*c*, and 1*d*, there are disposed charge-eliminating exposure lamps 21*a*, 21*b*, 21*c*, and 21*d*, drum-charging devices 2*a*, 2*b*, 2*c*, and 2*d*, laser beam-emitting exposure devices 17*a* as image exposure section, potential sensors 22*a*, 22*b*, 22*c*, and 22*d*. The electrophotographic photoconductor drums 1*a*, 1*b*, 1*c*, and 1*d*, whose static electricity is eliminated by the charge-eliminating exposure lamps 21*a*, 21*b*, 21*c*, and 21*d*, are uniformly charged by the drum-charging devices 2*a*, 2*b*, 2*c*, and 2*d* (charging step). And then, the electrophotographic photoconductor drums 1*a*, 1*b*, 1*c*, and 1*d* are exposed to laser beams emitted by the laser beam-emitting exposure devices 17*a*, whereby electrostatic latent images having undergone color separation processing are formed on the electrophotographic photoconductor drums 1*a*, 1*b*, 1*c*, and 1*d* according to image signals (latent image forming step). The image forming apparatus can suitably employ, as the above image exposure section, not only the laser beam-emitting exposure devices 17*a* but also known multi-valued exposure section which can emit a beam in a plurality of levels of light quantity in addition to a an off (zero quantity)-level, for each of units of image elements (pixels), as in the case of an LED (light emitting diode) array exposure device.

The electrostatic latent images formed on the electrophotographic photoconductor drums 1*a*, 1*b*, 1*c*, and 1*d* are developed by the developing section into visible images (developing step). More specifically, the developing section includes developing devices 3*a*, 3*b*, 3*c*, and 3*d* having predetermined amounts of developing agents of cyan, magenta, yellow, and black colors contained therein, respectively, so as to develop the electrostatic latent images formed on the electrophotographic photoconductor drums 1*a*, 1*b*, 1*c*, and 1*d* into visible images (toner images).

Next, a description will be given of a transfer section.

A recording material 6*y* held in a recording material-holding cassette 60 is supplied to the recording material carrier 18 via a resist roller.

When the recording material carrier 18 starts to be rotated, a recording material is carried from the resist roller to the recording material carrier 18. At this time, an image-writing signal is turned ON, and an image is formed on the first electrophotographic photoconductor drum 1*a* in appropriate timing.

Disposed below the first electrophotographic photoconductor drum 1*a* are a transfer charging device 4*a* and a transfer urging member 41*a*. A uniform urging force is applied toward the electrophotographic photoconductor drum 1*a* by the transfer urging member 41*a*, and at the same time an electric field is imparted by the transfer charging device 4*a*, whereby the toner image on the electrophotographic photoconductor drum 1*a* is transferred onto the recording material. At this time, the recording material is held on the recording material carrier 18 by an electrostatic attraction force, and the recording material is carried to the second image forming section Pb, where the next transfer operation is carried out. In the following, toner images formed by the third and fourth image forming sections Pc and Pd are transferred onto the recording material by the same method as described above. The recording material has static electricity thereof eliminated by a separation charging device (separation electrode) 9*y*, whereby it is released from the recording material carrier 18 due to reduced electrostatic attraction force, and is carried to the fixing section (fixing device) 10*y*.

The fixing section 10*y* is comprised of a fixing roller 71, a pressurizing roller 72, heat-resistant cleaning members 73 and 74 for cleaning the respective rollers 71 and 72, heaters 75 and 76 for heating the respective rollers 71 and 72, an oil applying roller 77 for applying a release agent oil, such as dimethylsilicone, to the fixing roller 71, an oil sump 78 for supplying the release agent oil, and a thermistor 79 for control of a fixing temperature.

After the transfer of the toner images, toners and the like remaining on the electrophotographic photoconductor drums 1*a*, 1*b*, 1*c*, and 1*d* are cleaned by photoconductor-cleaning sections 5*a*, 5*b*, 5*c*, and 5*d* (cleaning step), to be made ready for the next latent image-forming operation to be successively performed. Further, the toners and the like remaining on the recording material carrier 18 have static electricity thereof eliminated by a belt charge-eliminating device, to thereby eliminate an electrostatic attraction force thereof, and then are cleaned by a cleaning device 62 provided with a non-woven fabric, in the present example. As the cleaning device 62, it is possible to use a fur brush, a blade, and a device using them in combination.

EXAMPLES

Now, Examples of the present invention will be described in detail. Of course, the present invention is by no means limited to these Examples. It should be noted that in the following, "parts" means "parts by mass".

<<electrophotographic photoconductor>>

<<Preparation of Liquid Dispersion>>

Intermediate layer dispersions were prepared as described hereinafter.

(Preparation of Intermediate Layer Dispersion 1)

| | |
|---|---|
| Polyamide resin "CM-8000" (available from Toray Industries Inc.): | 1.0 part |
| Titanium oxide "SMT-500-SAS" (available from TAYCA Corp; surface treatment was effected by silica treatment, alumina treatment, methylhydrogenpolysiloxane treatment): | 3.0 parts |
| Methanol: | 10 parts |

The polyamide resin was dispersed for 10 hours by the batch method using a sand mill as a dispersion machine, whereby an intermediate layer dispersion 1 was prepared.

(Preparation of Intermediate Layer Dispersion 2)

1.0 part of polyamide resin "CM-8000" (available from Toray Industries Inc.) was added to a solvent mixture of 7 parts of methanol and 3 parts of 1-propanol, and dissolved, whereby an intermediate layer dispersion 2 was prepared.

(Preparation of Intermediate Layer Dispersion 3)

| | |
|---|---|
| Zirconium chelate compound "ZC-540" (available from Matsumoto Chemical Industry Co., Ltd.): | 200 parts |
| Silane coupling agent "KBN-903" (available from Shin-Etsu Chemical Co., Ltd.): | 100 parts |
| Methanol: | 700 parts |
| Ethanol: | 300 parts |

A solution of a mixture of these was prepared to form an intermediate layer dispersion 3.

<<Preparation of Electrophotographic Photoconductor>>

Photoconductor 1

The following intermediate layer coating solution 1 was prepared, and applied to a washed cylindrical aluminum substrate by a dip coating method, whereby an intermediate layer having a dry film thickness of 2 μm was formed. The intermediate layer was dried slowly at a low temperature such that Benard cells were stably produced. More specifically, the intermediate layer was dried at 60° C. for 90 minutes, and then further dried at 40° C. for 30 minutes.

<Intermediate layer (UCL) Coating Liquid 1>

The intermediate layer dispersion 1 was diluted with the same solvent mixture by a factor of two, was allowed to stand overnight, and thereafter filtrated (filter; Rigimesh filter available from Nippon Pall Corporation; nominal filtration accuracy; 5μ, pressure; 50 kPa).

The components of the following composition were mixed, and dispersed by the sand mill, whereby a charge generating layer coating liquid was prepared. This coating liquid was deposited by the dip coating method, whereby a charge generating layer having a dry film thickness of 0.3 μm was formed on the intermediate layer.

[Charge Generating Layer (CGL) Coating Liquid]

| | |
|---|---|
| Y-type oxy-titanyl phthalocyanine (maximum peak angle of X-ray diffraction by a Cu-Kα characteristic X-ray is 27.3 at 2θ): | 20 g |
| Polyvinylbutyral (# 6000-C, available from Denki Kagaku Kogyo KK): | 10 parts |
| Butyl-t-acetate: | 700 parts |
| 4-methoxy-4-methyl-2-pentanone: | 300 parts |

The components of the following composition were mixed, and dissolved, whereby a charge transport layer coating liquid was prepared. This coating liquid was deposited on the charge generating layer by the dip coating method, and a charge transport layer having a film thickness of 24 μm was formed, whereby the photoconductor 1 was prepared.

<Charge Transport Layer (CTL) Coating Liquid>

| | |
|---|---|
| Charge transport material [N-(4-methylphenyl)-N-{4-(β-phenylstyryl)phenyl}-p-toluidine: | 75 parts |
| Polycarbonate resin "Iupilon-Z300" (available from Mitsubishi Gas Chemical Company, Inc.): | 100 parts |
| THF/toluene (volume ratio 7/3): | 750 parts |

Photoconductor 2

A photoconductor 2 was prepared in the same manner as the photoconductor 1 was prepared except that the intermediate layer dispersion 2 was used in place of the intermediate layer dispersion 1 used in preparing the photoconductor 1, and the intermediate layer was formed to have a dry film thickness of 0.5 μm.

Photoconductor 3

A photoconductor 3 was prepared in the same manner as the photoconductor 1 was prepared except that the intermediate layer dispersion 3 was used in place of the intermediate layer dispersion 1 used in preparing the photoconductor 1, and the intermediate layer was formed to have a dry film thickness of 0.5 μm.

Photoconductor 4

A photoconductor 4 was prepared in the same manner as the photoconductor 1 was prepared except that a cylindrical aluminum substrate subjected to anodic oxidation sealing was used for the substrate.

<<Mass Additive>>

Figure 8A:
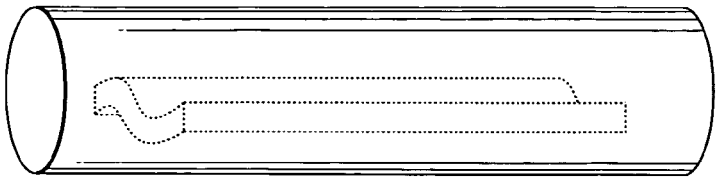

Mass Additive 1 (Refer to FIG. 8A)

A plate (300 mm long×70 mm wide×10 mm thick, 12.2 g) made of a resin foam "Calm Flex F9M" (available from INOAC Corp) brought into intimate contact with the inner surface of the electrophotographic photoconductor drum (corresponding to 11% of the mass of the electrophotographic photoconductor including a flange).

Figure 8B:
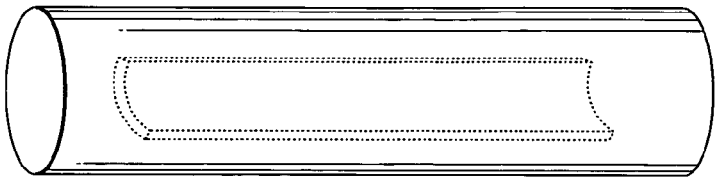

Mass Additive 2 (Refer to FIG. 8B)

A plate (the same size as above, 11.7 g) made of a resin foam "Calm Flex F6" (available from INOAC Corp) brought into intimate contact with the inner surface of the electrophotographic photoconductor drum (corresponding to 10% of the mass of the electrophotographic photoconductor including the flange).

Figure 8C:
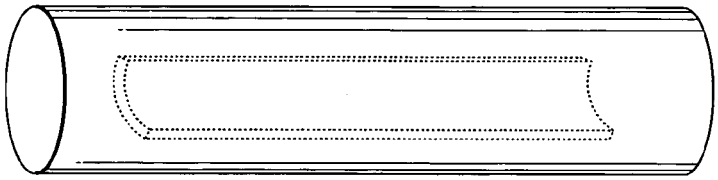

Mass Additive 3 (Refer to FIG. 8C)

A plate (the same size as above) made of a polystyrene foam brought into contact with the inner surface of the electrophotographic photoconductor drum by using its own elasticity (corresponding to 5% of the mass of the electrophotographic photoconductor including the flange).

Figure 8D:
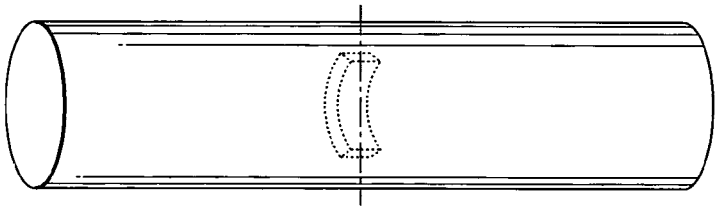

Mass Additive 4 (Refer to FIG. 8D)

A cylindrical iron body having a weight of 60 g adhered to the inner surface of a central portion of the electrophotographic photoconductor drum (corresponding to 54% of the mass of the electrophotographic photoconductor including the flange).

Figure 8E:
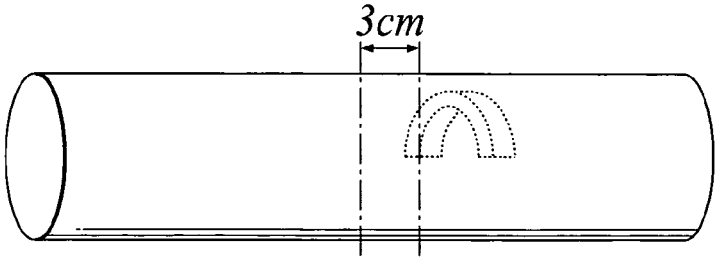

Mass Additive 5 (Refer to FIG. 8E)

A semi-cylindrical aluminum body having a weight of 15 g adhered to the inner surface of a portion of the electrophotographic photoconductor drum, 3 cm away from the center of the electrophotographic photoconductor drum (corresponding to 13% of the mass of the electrophotographic photoconductor including the flange).

Figure 8F:
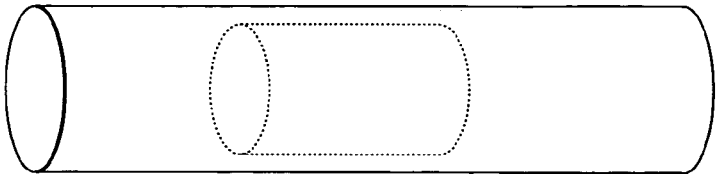

Mass Additive 6 (Refer to FIG. 8F)

A plate having a thickness of 3 mm (corresponding to 5% of the mass of the electrophotographic photoconductor including the flange) made of polyphenylene sulfide, brought into contact with the inside of the electrophotographic photoconductor drum by using its own elasticity.

<<Developing Agent>>

<<Preparation of Latex 1>>

A separable flask having a capacity of 5000 ml and equipped with a stirring device, a temperature sensor, a cooling pipe, and a nitrogen-introducing device was charged with a solution obtained by dissolving 7.08 g of anionic activator (sodium dodecylbenzenesulfonate: SDS) in 2760 g of ion-exchange water, and the internal temperature was raised to 80° C., with stirring at a stirring speed of 230 rpm under a nitrogen gas stream. 72.0 g of an exemplified compound 19 was added to a monomer consisting of 115.1 g of styrene, 42.0 g of n-butyl acrylate, and 10.9 g of methacrylic acid, and the resulting mixture was heated to 80° C. to dissolve the exemplified compound to thereby prepare a monomer solution. Then, the above heated solutions were mixed and dispersed by using a mechanical dispersing apparatus having a circulation path, whereby emulsified particles dispersed with a uniform dispersed particle size was prepared. After that, an initiator solution prepared by dissolving 0.84 g of polymerization initiator (potassium persulfate: KPS) in 200 g of ion-exchange water was added to the dispersion, and the system was heated with stirring at 80° C. for three hours, whereby latex particles were prepared. A solution prepared by dissolving 7.73 g of polymerization initiator (KPS) in 240 ml of ion-exchange water was added to the obtained latex particles, and after 15 minutes, when the temperature was 80° C., a mixture consisting of 383.6 g of styrene, 140.0 g of n-butyl acrylate, 36.4 g of methacrylic acid, and 14 g of n-octyl-3-melcaptopropionic acid ester was dropwise added over 120 minutes. The resulting system was heated with stirring for 60 minutes, and then cooled down to 40° C., whereby latex particles were obtained. The latex particles will be referred to as the "latex 1".

<<Preparation of Colored Particles>>

(Preparation of Colored Particles 1Bk)

9.2 g of sodium n-dodecyl sulfate was dissolved in 160 ml of ion-exchange water, with stirring. While stirring the solution, 20 g of Regal 330R (carbon black available from Cabot Corporation) was gradually added thereto, and then dispersed using Clear Mix. A particle size of the colorant particles in the obtained colorant dispersion was measured using the electrophoretic light scattering spectrophotometer "ELS-800" (available from Otsuka Electronics Co., Ltd.). The measured particle size was 120 nm in weight average particle size. The dispersion will be referred to as the "colorant dispersion 1".

A four-neck flask having a capacity of 5 liters and equipped with a temperature sensor, a cooling pipe, a nitrogen-introducing device, and a stirring device was charged with 1250 g of the "latex 1", 2000 ml of ion-exchange water, and the "colorant dispersion 1". After the internal temperature was adjusted to 30° C., 5 mol/liter of aqueous sodium hydroxide solution was added to the mixture to adjust the pH to 10.0. Then, to the resulting liquid mixture, a solution prepared by dissolving 52.6 g of magnesium chloride hexahydrate in 72 ml of ion-exchange water was added with stirring at 30° C. over 5 minutes. The mixture was allowed to stand for 2 minutes, and the temperature of the system started to be raised up to 90° C. over 5 minutes (temperature-raising rate of 14° C./min). In this state, particle sizes of the growing particles were measured using the "Coulter Counter TA-II", and when the volume average particle size reached 4.3 μm, a solution prepared by dissolving 115 g of sodium chloride in 700 ml of ion-exchange water was added to stop the growth of the particles. Further, the salting out/fusing of particles was continued by heating at a liquid temperature of 85±2° C. for 8 hours with stirring. Subsequently, the system was cooled down to 30° C. at a cooling rate of 6° C./min, and hydrochloric acid was added to adjust the pH to 2.0, followed by stopping the stirring operation. The generated colored particles were filtered and washed, and then, dried in a warm air flow at 40° C., to thereby obtain colored particles. The colored particles obtained will be referred to as the "colored particles 1Bk".

(Preparation of Colored Particles 1Y)

Colored particles were obtained in the same manner as the colored particles 1Bk were prepared except that C.I. pigment yellow 185 was used in place of the carbon black used in preparing the colored particles 1Bk. The colored particles obtained will be referred to as the "colored particles 1Y".

(Preparation of Colored Particles 1M)

Colored particles were obtained in the same manner as the colored particles 1Bk were prepared except that C.I. pigment red 122 was used in place of the carbon black. The colored particles obtained will be referred to as the "colored particles 1M".

(Preparation of Colored Particles 1C)

Colored particles were obtained in the same manner as the colored particles 1Bk were prepared except that C.I. pigment blue 15:3 was used in place of the carbon black. The colored particles obtained will be referred to as the "colored particles (1C)".

(Preparation of Colored Particles 2Bk, 3Bk, 4Bk, and 5Bk)

Colored particles 2Bk, 3Bk, 4Bk, and 5Bk were obtained in the same manner as the colored particles 1Bk were prepared except that manufacturing conditions for manufacturing the colored particles 1Bk were changed to manufacturing conditions shown in Table 1.

(Preparation of Colored Particles 6Bk to 8Bk)

Colored particles 6Bk to 8Bk were obtained in the same manner as the colored particles 1Bk were prepared except that manufacturing conditions for manufacturing the colored particles 1Bk were changed to manufacturing conditions shown in Table 1, and the growth of the particles was stopped when the volume average particle size reached 3.8 μm, whereby the colored particles 6Bk to 8Bk were prepared.

(Preparation of Colored Particles 9Bk to 11Bk)

Colored particles 9Bk to 11Bk were obtained in the same manner as the colored particles 1Bk were prepared except that manufacturing conditions for manufacturing the colored particles 1Bk were changed to manufacturing conditions shown in Table 1, and the growth of the particles was stopped when the volume average particle size reached 5.5 μm, whereby the colored particles 9Bk to 11Bk were prepared.

(Preparation of Colored Particles 12Bk and 13Bk)

Colored particles 12Bk and 13Bk were obtained in the same manner as the colored particles 1Bk were prepared except that the growth of the particles was stopped when the volume average particle size reached 1.5 μm, and 9.3 μm, whereby the colored particles 12Bk and 13Bk were prepared, respectively.

(Preparation of Colored Particles 4Y)

Colored particles were obtained in the same manner as the colored particles 4Bk were prepared except that C.I. pigment yellow 185 was used in place of the carbon black. The colored particles obtained will be referred to as the "colored particles 4Y".

(Preparation of Colored Particles 4M)

Colored particles were obtained in the same manner as the colored particles 4Bk were prepared except that C.I. pigment red 122 was used in place of the carbon black. The colored particles obtained will be referred to as the "colored particles 4M".

(Preparation of Colored Particles 4C)

Colored particles were obtained in the same manner as the colored particles 4Bk were prepared except that that C.I. pigment blue 15:3 was used in place of the carbon black. The colored particles obtained will be referred to as the "colored particles 4C".

Manufacturing conditions for manufacturing the colored particles are shown in Table 1, and the physical properties of the colored particles obtained are shown in Table 2.

TABLE 1

| COLORED PARTICLE NUMBER | ADDED AMOUNT OF MAGNESIUM CHLORIDE (g) | TEMPERATURE-RAISING RATE (° C./min) | SALTING-OUT/FUSING LIQUID TEMPERATURE | SALTING-OUT/FUSING HOLDING TIME(HOURS) |
|---|---|---|---|---|
| COLORED PARTICLE 1BK | 52.6 | 12 | 85 ± 2° C. | 8 |
| COLORED PARTICLE 1Y | 52.6 | 12 | 85 ± 2° C. | 8 |
| COLORED PARTICLE 1M | 52.6 | 12 | 85 ± 2° C. | 8 |
| COLORED PARTICLE 1C | 52.6 | 12 | 85 ± 2° C. | 8 |
| COLORED PARTICLE 2BK | 52.6 | 20 | 90 ± 2° C. | 6 |
| COLORED PARTICLE 3BK | 52.6 | 5 | 90 ± 2° C. | 6 |
| COLORED PARTICLE 4BK | 26.3 | 12 | 85 ± 2° C. | 8 |
| COLORED PARTICLE 5BK | 78.9 | 12 | 85 ± 2° C. | 8 |
| COLORED PARTICLE 6BK | 52.6 | 12 | 85 ± 2° C. | 8 |
| COLORED PARTICLE 7BK | 43.3 | 12 | 85 ± 2° C. | 8 |
| COLORED PARTICLE 8BK | 78.9 | 12 | 85 ± 2° C. | 8 |
| COLORED PARTICLE 9BK | 52.6 | 12 | 85 ± 2° C. | 8 |
| COLORED PARTICLE 10BK | 35.5 | 12 | 85 ± 2° C. | 8 |
| COLORED PARTICLE 11BK | 78.9 | 12 | 85 ± 2° C. | 8 |

TABLE 2

| COLORED PARTICLE NUMBER | 50% VOLUME AVERAGE PARTICLE SIZE (Dv50) (μm) | 50% NUMBER AVERAGE PARTICLE SIZE (Dp50) (μm) | Dv50/Dp50 | CUMULATIVE 75% VOLUME PARTICLE SIZE (Dv75) (μm) | CUMULATIVE 75% NUMBER PARTICLE SIZE (Dp75) (μm) | Dv75/Dp75 | NUMBER % OF PARTICLES NOT GREATER THAN 0.7 × Dp50 |
|---|---|---|---|---|---|---|---|
| COLORED PARTICLE 1BK | 4.6 | 4.3 | 1.07 | 4.1 | 3.7 | 1.11 | 7.8 |
| COLORED PARTICLE 1Y | 4.6 | 4.3 | 1.07 | 4.1 | 3.7 | 1.11 | 7.6 |
| COLORED PARTICLE 1M | 4.7 | 4.4 | 1.07 | 4.2 | 3.7 | 1.14 | 7.9 |
| COLORED PARTICLE 1C | 4.6 | 4.3 | 1.07 | 4.1 | 3.7 | 1.11 | 7.8 |
| COLORED PARTICLE 2BK | 4.8 | 4.5 | 1.07 | 4.2 | 3.7 | 1.14 | 5.5 |
| COLORED PARTICLE 3BK | 4.5 | 4.1 | 1.1 | 4 | 3.4 | 1.18 | 8.2 |
| COLORED PARTICLE 4BK | 4.6 | 3.7 | 1.24 | 4.1 | 3.1 | 1.32 | 13.6 |
| COLORED PARTICLE 4Y | 4.6 | 3.7 | 1.24 | 4.1 | 3.1 | 1.32 | 13.6 |
| COLORED PARTICLE 4M | 4.6 | 3.7 | 1.24 | 4.1 | 3.1 | 1.32 | 13.5 |
| COLORED PARTICLE 4C | 4.6 | 3.7 | 1.24 | 4.1 | 3.1 | 1.32 | 13.3 |
| COLORED PARTICLE 5BK | 4.7 | 4.3 | 1.09 | 4.1 | 3.6 | 1.14 | 6.3 |
| COLORED PARTICLE 6BK | 3.9 | 3.7 | 1.05 | 3.3 | 2.8 | 1.18 | 6.8 |
| COLORED PARTICLE 7BK | 3.8 | 3.4 | 1.12 | 3.2 | 2.7 | 1.18 | 11.3 |
| COLORED PARTICLE 8BK | 3.9 | 3.8 | 1.03 | 3.3 | 2.8 | 1.18 | 6.3 |
| COLORED PARTICLE 9BK | 5.6 | 5.3 | 1.06 | 5.1 | 4.5 | 1.13 | 8.5 |
| COLORED PARTICLE 10BK | 5.5 | 4.8 | 1.15 | 4.9 | 4 | 1.23 | 12.5 |
| COLORED PARTICLE 11BK | 5.7 | 5.4 | 1.06 | 5.1 | 4.4 | 1.16 | 6.3 |
| COLORED PARTICLE 12BK | 1.5 | 1.4 | 1.08 | 1.2 | 1.0 | 1.16 | 8.5 |
| COLORED PARTICLE 13BK | 9.3 | 8.7 | 1.07 | 7.8 | 7.1 | 1.10 | 6.8 |

(Preparation of Toner Particles)

To the obtained colored particles 1Bk to 13Bk, the colored particles 1Y, 1M, 1C, 4Y, 4M, and 4C, 1 mass % of hydrophobic silica (number average primary particle size: 12 nm, degree of hydrophobicity: 68), and hydrophobic titanium oxide (number average primary particle size: 20 nm, degree of hydrophobicity: 63) were added, and mixed by the Henschel mixer, whereby toners 1Bk to 13Bk, toners 1Y to 1C, and toners 4Y to 4C were obtained.

It should be noted that the physical properties, such as shapes and particle sizes, of the toners were the same as data of the physical properties of the colored particles shown in Table 2.

(Preparation of Developing Agents)

Each of the above types of toner particles is mixed with ferrite carrier particles coated with silicone resin, and having a volume average particle size of 60 μm, whereby developing agents 1Bk to 13Bk, developing agents 1Y to 1C, and developing agents 4Y to 4C, all of which have a tone concentration of 6%, were prepared, respectively.

Subsequently, the above photoconductors 1 to 4, the mass-adding bodies, the developing agents were combined with each other as indicated in Table 3 (Examples 1 to 12, and Comparative Examples 1 to 6), to form images by using evaluating machines, such as modified machines 1 and 2 of "Sitios 7040" (digital copying machine, available from Konica Corporation), and obtained images were evaluated for comparison.

Modified Machine 1

The charging device was changed from a scorotron to the charging roller appearing in FIG. 4.

Modified Machine 2

The charging device was changed from a scorotron to the charging roller appearing in FIG. 4.

<<Evaluation of Image Quality>>

100,000 copies of an original image formed by a character image, a photo of a human face, an all white image, and an all black image, each having a pixel ratio of 70%, and occupying one of four equal areas of the original image, were continuously copied, and evaluated after termination of the continuous copying operation.

Criteria for evaluations are shown hereinafter. The results of the evaluations are shown in Table 3.

Fogging: Absolute reflection density of the all white image was measured by using a Macbeth reflection densitometer "RD-918".

A . . . 0.005 or less (favorable)

B . . . 0.005 or more and smaller than 0.01 (level presenting no practical problems)

D . . . 0.01 or more (presenting practical problems)

Sharpness: determined by fine-line images

On the other hand, sharpness was determined based on generational copies of a Japanese Kanji letter "塵" in Mincho typeface/9.6 point. The character image of "塵" was copied through ten generations, and it was visually checked by ten persons whether or not the character image is legible as a letter, whereby the number of generations of legible letter was determined based on an average value of evaluations values of the ten persons.

<<Evaluation of Cleaning Property>>

Ranks of abnormal noises (e.g. blade squeaking), and curling of blade, which occurred during the continuous copying operation. The cleaning was performed by the blade cleaning method.

A . . . There occurred no abnormal noise nor curling of blade. Cleaning property as well is favorable.

C . . . There occurred abnormal noises or curling of blade.

D . . . There occurred both abnormal noises and curling of blade.

Uneven abrasion (Film thickness of each photoconductor was measured at 50 locations thereof at intervals equally spaced in the horizontal and vertical directions with respect to the axis of the cylinder, whereby differences in film thickness dependent on the locations of the photoconductor were determined.)

A . . . Maximum difference 2 μm or less (favorable)

B . . . Difference 2 to 4 μm (level presenting no practical problems)

D . . . Difference larger than 4 μm (presenting practical problems)

The results of the evaluation are shown in Table 3.

TABLE 3

| EXAMPLE/ COMPARATIVE EXAMPLE | ELECTRO-PHOTO-GRAPHIC PHOTO-CONDUCTOR NO. | MASS ADDI-TIVE | DE-VEL-OPING AGENT No. | EVALUATING MACHINE | IMAGE EVALUATION FOGGING | SHARP-NESS | HALF-TONE UNEVEN-NESS | CLEAN-ING PROP-ERTY | UNEVEN ABRASION |
|---|---|---|---|---|---|---|---|---|---|
| EXAMPLE 1 | 1 | 1 | 1BK | MODIFIED MACHINE 1 | A | A | A | B | A |
| COMPARATIVE EXAMPLE 1 | 1 | NONE | 1BK | MODIFIED MACHINE 1 | B | A | D | D | D |
| EXAMPLE 2 | 2 | 2 | 2BK | MODIFIED MACHINE 1 | B | B | A | B | B |
| EXAMPLE 3 | 2 | 3 | 2BK | MODIFIED MACHINE 1 | B | B | A | B | B |
| EXAMPLE 4 | 3 | 1 | 3BK | MODIFIED MACHINE 1 | A | A | A | B | A |
| COMPARATIVE EXAMPLE 2 | 1 | NONE | 3BK | MODIFIED MACHINE 1 | D | B | D | D | D |
| COMPARATIVE EXAMPLE 3 | 1 | 4 | 4BK | MODIFIED MACHINE 1 | B | B | D | C | B |
| COMPARATIVE EXAMPLE 4 | 3 | 5 | 7BK | MODIFIED MACHINE 1 | B | B | D | C | B |
| EXAMPLE 5 | 1 | 1 | 5BK | MODIFIED MACHINE 2 | A | A | A | B | A |
| EXAMPLE 6 | 2 | 6 | 2BK | MODIFIED MACHINE 2 | B | B | A | B | B |
| EXAMPLE 7 | 2 | 6 | 6BK | MODIFIED MACHINE 2 | B | B | A | B | B |
| EXAMPLE 8 | 4 | 5 | 8BK | MODIFIED MACHINE 2 | B | B | A | B | B |
| EXAMPLE 9 | 4 | 5 | 9BK | MODIFIED MACHINE 2 | B | B | A | B | B |
| EXAMPLE 10 | 4 | 5 | 11BK | MODIFIED MACHINE 2 | B | B | A | B | B |
| COMPARATIVE EXAMPLE 5 | 1 | NONE | 4BK | MODIFIED MACHINE 2 | D | A | D | D | D |
| COMPARATIVE EXAMPLE 6 | 1 | 1 | 10BK | MODIFIED MACHINE 2 | B | B | D | C | B |
| EXAMPLE 11 | 1 | 1 | 12BK | MODIFIED MACHINE 2 | B | B | B | C | B |
| EXAMPLE 12 | 1 | 1 | 13BK | MODIFIED MACHINE 2 | B | B | A | B | B |

A . . . 9 generations or more (favorable)

B . . . 5 to 8 generations (level presenting no practical problems)

D . . . 4 generations or less (presenting practical problems)

Unevenness of halftone: determined based on the difference (ΔHD=maximum density−minimum density) in a halftone image A . . . 0.05 or less (favorable)

B . . . 0.05 or more and smaller than 1 (level presenting no practical problems)

D . . . 0.1 or more (presenting practical problems)

From Table 3, it is obvious that the combinations of electrophotographic photoconductors and developing agents according to the Examples 1 to 12 provide images higher in quality and exhibit excellent cleaning properties compared with the combination according to the Comparative Examples 1 to 6.

<<Evaluation of Color Difference>>

Using a combination of developing agent groups, electrophotographic photoconductors, and mass-adding bodies shown in Table 4 (Example 13, and Comparative Examples 7 and 8), and a color copying machine shown in FIG. 7, evaluation was performed. The developing devices of Y/M/C/Bk were arranged around the laminated-type electrophotographic photoconductor, and the colors were developed on the electrophotographic photoconductors, respectively. Then, the developed color images were transferred to a transfer material (paper) to thereby form a full-color image. The cleaning of the electrophotographic photoconductors were performed by the blade cleaning method. The fixation of the image was performed using a heating fixing device of pressure-contact type.

The evaluation was carried out by printing on 1000 sheets at a 25% full-color pixel ratio under the high-temperature high-humidity environment of 30° C./80% RH, and the color difference between an image on the first sheet and an image on the 1000th sheet was evaluated. The color difference was evaluated by the following method:

That is, colors of a corresponding solid image portion of secondary colors (red, blue, and green) on each image was measured by "Macbeth Color-Eye 7000", and the color difference was calculated using the CMC (2:1) color difference equation.

The color difference obtained by the CMC (2:1) color difference equation has a smaller value as the color difference is smaller. When the color differences is not greater than 5, it means that a change in the color tint of an image is at an acceptable level. The obtained results are shown in Table 4.

TABLE 4

| EXAMPLE/ COMPARATIVE EXAMPLE | ELECTRO-PHOTOGRAPHIC PHOTO-CONDUCTOR NO. | DEVELOPING AGENT GROUP | MASS ADDITIVE | COLOR DIFFERENCE | HALFTONE UNEVENNESS |
|---|---|---|---|---|---|
| EXAMPLE 13 | 1 | DEVELOPING AGENT 1BK TO DEVELOPING AGENT 1C | 1 | 1 | A |
| COMPARATIVE EXAMPLE 7 | 3 | DEVELOPING AGENT 4BK TO DEVELOPING AGENT 4C | 1 | 7 | B |
| COMPARATIVE EXAMPLE 8 | 1 | DEVELOPING AGENT 1BK TO DEVELOPING AGENT 1C | NONE | 3 | C |

From Table 4, it is obvious that the combination of the electrophotographic photoconductor and the developing agents according to the Example 13 are much smaller in color difference and unevenness of halftone than the combination according to the Comparative Examples 7 and 8.

What is claimed is:

1. An image forming method comprising:

forming a latent image on a cylindrical electrophotographic photoconductor including a mass additive therein; and developing the latent image, with a developer comprising a toner, wherein the toner has (1) a ratio (Dv50/Dp50) of a 50% volume particle size (Dv50) to a 50% number particle size (Dp50) of 1.0 to 1.15, (2) a ratio (Dv75/Dp75) of a cumulative 75% volume particle size (Dv75) from a larger volume particle size to a cumulative 75% number particle size (Dp75) from a larger number particle size of 1.0 to 1.20, and (3) toner particles having a particle size of 0.7×(Dp50) or less in an amount of 10 number % or less.

2. The image forming method of claim 1, wherein at least part of the mass additive or part of a member enclosing the mass additive is in contact with an inner surface of the electrophotographic photoconductor.

3. The image forming method of claim 1, wherein the mass additive is a vibration-restraining material.

4. The image forming method of claim 1, wherein the mass additive is a noise-absorbing material.

5. The image forming method of claim 1, wherein the 50% volume particle size (Dv50) is 2 to 8 μm.

6. The image forming method of claim 1, wherein the toner comprises a colored particle obtained by polymerization of at least a polymerizable monomer in an aqueous medium.

7. The image forming method of claim 1, wherein the toner comprises a colored particle obtained by salting-out/fusing at least resin a particle in an aqueous medium.

8. The image forming method of claim 1, wherein the toner comprises a styrene-(meta)acrylate resin.

9. The image forming method of claim 1, comprising cleaning the toner on the electrophotographic photoconductor with a cleaning blade of polyurethane.

10. The image forming method of claim 1, comprising charging the electrophotographic photoconductor by a contact charging method.

11. The image forming method of claim 10, wherein the charging is performed by a charging roller.

12. The image forming method of claim 10, wherein the charging is performed by a charging blade.

13. The image forming method of claim 10, wherein the charging is performed by a magnetic brush.

14. The image forming method of claim 1, wherein the ratio (Dv50/Dp50) of the 50% volume particle size (Dv50) to the 50% number particle size (Dp50) is 1.0 to 1.13.

15. The image forming method of claim 1, wherein the ratio (Dv75/Dp75) of the cumulative 75% volume particle size (Dv75) from the larger volume particle size to the cumulative 75% number particle size (Dp75) from the larger number particle size is 1.1 to 1.19.

16. The image forming method of claim 1, wherein the toner comprises toner particles having the particle size of 0.7×(Dp50) or less in an amount of 5 to 9 number %.

17. The image forming method of claim 1, wherein a weight of the mass additive is not less than 3 g.

18. The image forming method of claim 1, wherein a weight of the mass additive is not less than 3% of a mass of the electrophotographic photoconductor including a flange.

19. The image forming method of claim 2, comprising charging the electrophotographic photoconductor by a contact charging method by a charging roller, a charging blade or a magnetic brush, wherein the 50% volume particle size (Dv50) is 2 to 8 μm, the ratio (Dv50/Dp50) is 1.0 to 1.13, the ratio (Dv75/Dp75) is 1.1 to 1.19, number of toner particles having a particle size of 0.7×(Dp50) or less is 5 to 9 number %; and a weight of the mass additive is not less than 3 g, and is not less than 3% of a mass of the electrophotographic photoconductor including a flange.

* * * * *